United States Patent [19]

Moore

[11] 4,263,842

[45] Apr. 28, 1981

[54] ADJUSTABLE LOUVER ASSEMBLY

[76] Inventor: Robert D. Moore, 800 S. Missouri, Marceline, Mo. 64658

[21] Appl. No.: 930,168

[22] Filed: Aug. 2, 1978

[51] Int. Cl.[3] ..... F24F 7/00

[52] U.S. Cl. ..... 98/121 A; 98/110; 415/121 A; 415/168

[58] Field of Search ..... 98/110, 121, 99.8; 160/236; 49/74, 91, 92; 137/601; 291/305, 306; 244/35 R, 123, 199, 200, 207; 415/121 A, 168

[56] References Cited

U.S. PATENT DOCUMENTS

| | | | |
|---|---|---|---|
| 2,362,831 | 11/1944 | Kraft | 415/168 |
| 2,375,176 | 5/1945 | Huff | 98/121 A |
| 2,845,153 | 7/1958 | West | 98/110 |
| 3,002,725 | 10/1961 | Ljungberg et al. | 415/121 A |
| 3,170,547 | 2/1965 | Wilcox | 98/110 |
| 3,463,418 | 8/1969 | Miksch | 244/199 |
| 3,578,264 | 5/1971 | Kuethe | 244/199 X |
| 3,682,084 | 8/1972 | Tarnoff | 98/121 A X |
| 3,683,786 | 8/1972 | Hedrick | 98/110 |
| 3,771,559 | 11/1973 | Alley | 98/110 X |
| 3,783,768 | 1/1974 | Caming et al. | 98/121 A X |
| 3,791,280 | 2/1974 | Williamson | 98/121 A X |
| 3,881,842 | 5/1975 | Kosyak et al. | 415/168 |
| 3,894,481 | 7/1975 | Alley | 98/121 A |
| 4,103,468 | 8/1978 | Olsen | 98/121 R X |
| 4,103,601 | 8/1978 | Dayus | 98/121 A X |

FOREIGN PATENT DOCUMENTS

| | | | |
|---|---|---|---|
| 2208259 | 8/1973 | Fed. Rep. of Germany | 98/121 A |
| 2406533 | 8/1975 | Fed. Rep. of Germany | 137/601 |
| 746746 | 6/1933 | France | 244/199 |
| 1227973 | 10/1960 | France | 160/236 |
| 83927 | 5/1954 | Norway | 251/305 |
| 300641 | 4/1971 | U.S.S.R. | 415/168 |

OTHER PUBLICATIONS

Van Nostrand's Scientific Encyclopedia, 4th Ed., D. Van Nostrand and Co., Inc., 1968, pp. 229 and 230.

*Primary Examiner*—Albert J. Makay
*Assistant Examiner*—Harold Joyce
*Attorney, Agent, or Firm*—Christie, Parker & Hale

[57] ABSTRACT

An adjustable louver blade assembly including a number of horizontally extending, movable louver blades (22). Each of the blades is formed in a generally hollow airfoil shaped cross section having a leading edge and a trailing edge. Trips (46,48) for inducing turbulent flow of the boundary layer are embossed on the blade surfaces. Reinforcing spacer ribbons (42) are frictionally secured within each blade to rigidize the blade.

The pivotal axis of each blade is located so that the axis is forward of the center of aerodynamic force exerted on the blade for all attitudes of the blade between a closed position and a position about 60° from the closed position. A control rod (26) is connected to each of the louver blades so that all of the blades can be simultaneously swung to any attitude between fully open and fully closed.

Each of the blades has chevron shaped slits (60) with inwardly bent tabs near the trailing and leading edges of the blade to guide water on the surface of the blade into the hollow blade. Water is discharged from exit ports (47) at the blade end into open vertical channels (82) in the side frames which conduct water to hollow corner conduits (84) for discharge.

152 Claims, 13 Drawing Figures

Fig. 6
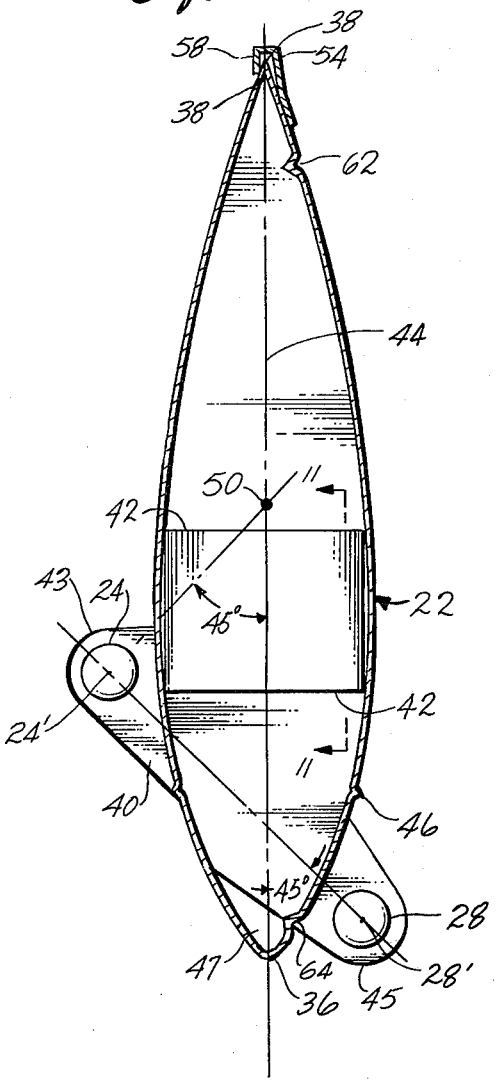
Fig. 8
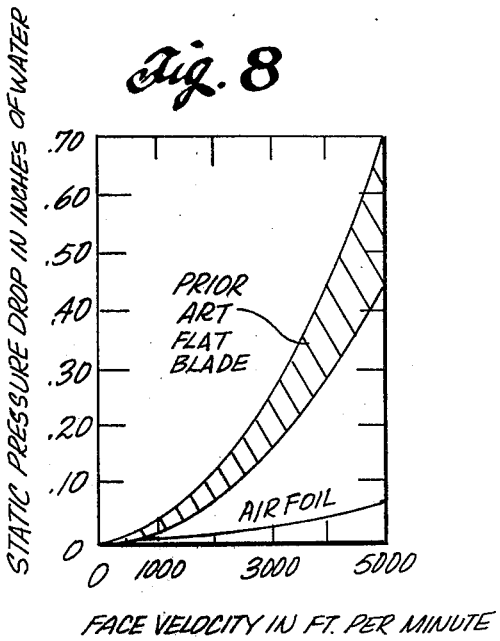
Fig. 10
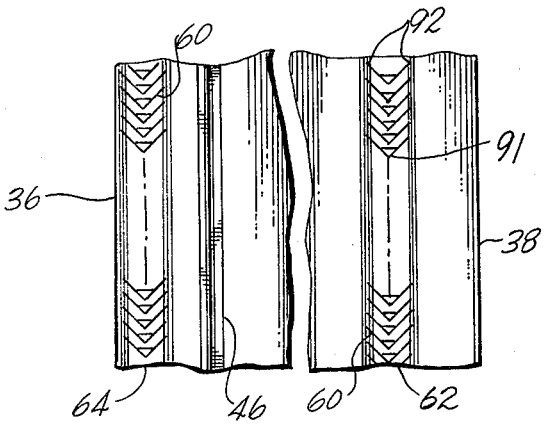
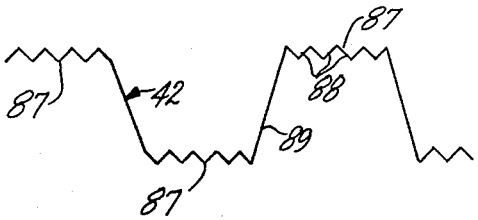
Fig. 11

ADJUSTABLE LOUVER ASSEMBLY

BACKGROUND

This application relates to adjustable louver systems and more particularly to louvers having a plurality of blades formed into hollow airfoil cross section and to rain resistant louver assemblies with means for minimizing water passing through the louver assembly.

Multiple blade louver systems to control air flow or light in architectural, heat exchanger, and solar light applications are well known. Industrial applications for louver systems to control air flow in factory and assembly plant areas are widespread. Louver assemblies are also commonly used adjacent large air-cooled heat exchangers and in cooling towers. Such systems due to the volume of the structures to be ventilated are generally large in size in order to control the high air flow rates through the system. Designers of louver blade assemblies appropriate for such applications have generally not addressed the aerodynamic implications of blade design as well as blade rigidity requirements to resist stress fatigue for louver blades under prolonged use.

Blades in common use for architectural purposes have not been designed with the objective of improving aerodynamic drag figures, consequently considerable energy is absorbed in the air stream wake at the trailing edge of the louver blade. Compensation for such energy absorption takes the form of high pressure drop through the louver assembly and thus increased power requirements for air fan drive motors resulting in an overall increase in the power supplied to the louver system as well as adding weight and therefore cost.

Another problem encountered with many louvers, particularly in high velocity air flows, such as above about 2,000 ft/min is that the blades not only interfere with the flow, but are noisy and rattle. To compensate for noise and the rattling, the blades are strengthened and made more rigid by increasing blade material thickness or by limitations on blade lengths. Both approaches restrict applicability of such louver blade systems because of the high weight and resulting material costs. If the weight increase is to be avoided, the blade length is limited, thereby increasing the number of parts required and increasing manufacturing and installation costs.

Prior art louver assemblies for preventing liquids such as rain water and atmospheric moisture from passing through the louver blade assembly, and therefore into the ventilated structure have particularly bad aerodynamics due to their convoluted shapes, resulting in extremely high power wastage, often several times the cost of a new louver in a year or so.

SUMMARY OF THE INVENTION

According to a presently preferred embodiment, there is provided a louver assembly housed in a rectangular frame having a plurality of airfoil shaped louver blades, each blade having a leading and a trailing edge. Each of the blades can be pivotally mounted in the frame for pivoting between an open position and a closed position with the blades approximately parallel to the plane of the frame. The pivotal axis of each of the blades is located between the leading edge of the blade and the center of aerodynamic force exerted on such a blade by air flowing past the blade for substantially all blade attitudes between the closed position and a position about 60° from the closed position. Actuation of a control rod that is pivotally mounted to each of the blades simultaneously changes the attitudes of all of the blades between the opened and closed positions.

To provide rain resistance each of the blades can have a plurality of holes through the blade surface adjacent to the leading edge or trailing edge, or preferably both edges, for guiding liquid on the surface of the blade into the hollow blade interior. Each blade has an exit port from which water entering the louver blade through the holes is guided to a suitable discharge means. Drainage channels can be provided along the sides and in the corners of the frame.

Such a louver blade can be fabricated from a single piece of uniform thickness sheet metal, in the shape of a closed, hollow, symmetrical airfoil. Each such blade has an aerodynamic trip raised above the surface of the airfoil along the length of the blade at a location aft of the leading edge of the blade for reducing drag by inducing turbulence in the boundary layer of air flowing past the surface of the airfoil, thereby preventing premature flow separation. Each of the blades can be reinforced with a web or sheet metal spacer strip, frictionally secured between the opposite inside surfaces of the airfoil and normal to the plane of the airfoil chord to resist collapse of the blade.

The louver frame has a wall trap with a smoothly curving portion for guiding liquid that flows down a wall towards the louver assembly to an appropriate gutter to prevent the liquid from entering the louver assembly and thereby being blown into the structure that is to be ventilated through the louver system. Side channels with a smoothly curving entrance also help prevent liquid from passing through the louver assembly.

BRIEF DESCRIPTION OF THE DRAWINGS

FIG. 6 is a transverse cross section of a blade;

FIG. 8 is a graph of static pressure drop across the surface of the blade versus air velocity over the blade;

FIG. 10 is a fragmentary plan view of the upper surface of a louver blade;

FIG. 11 is an edge view of a spacer ribbon inside a blade;

DESCRIPTION

Figure 1:
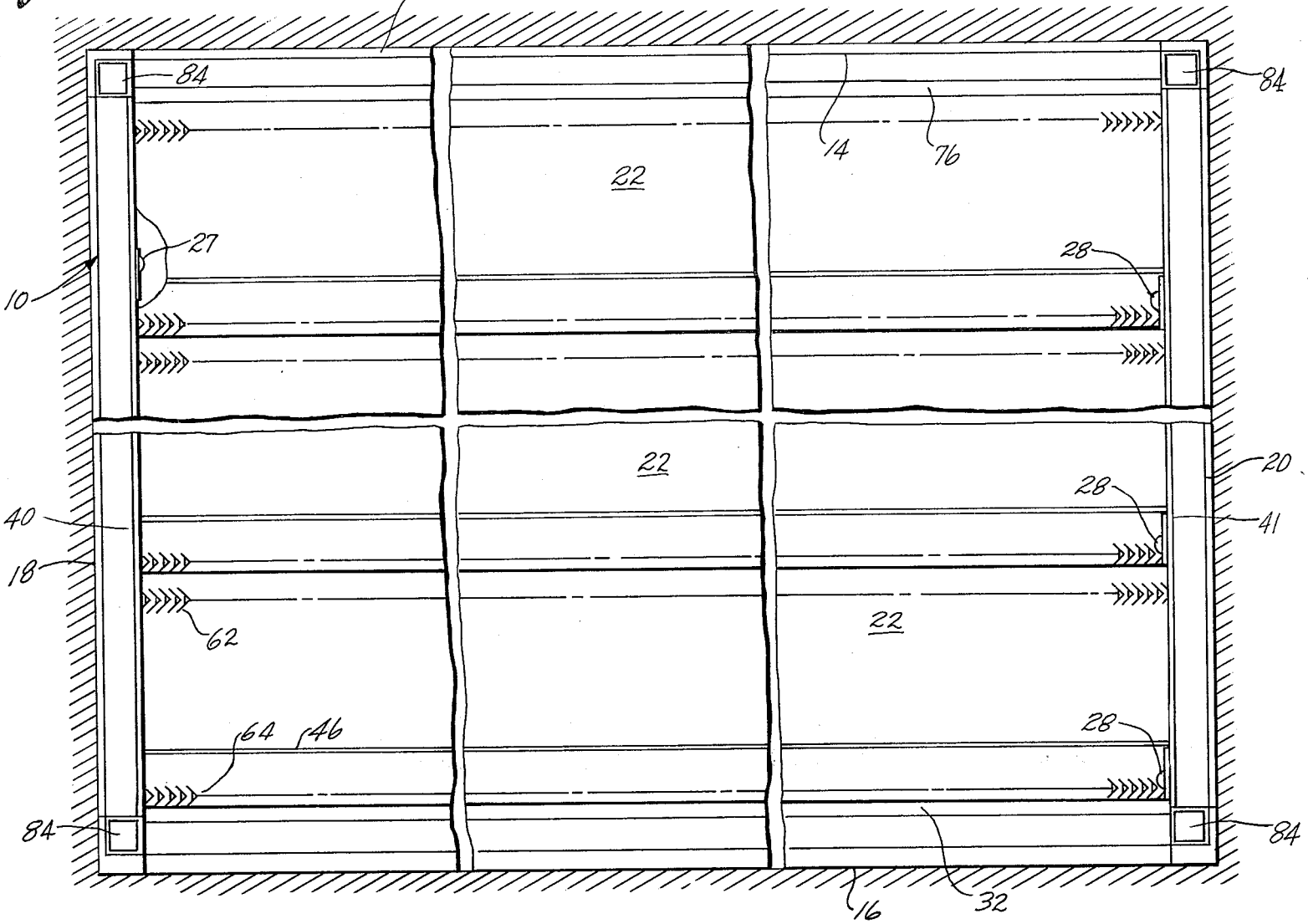
FIG. 1 is a front view of the louver assembly with the louver blades closed.
Figure 2:
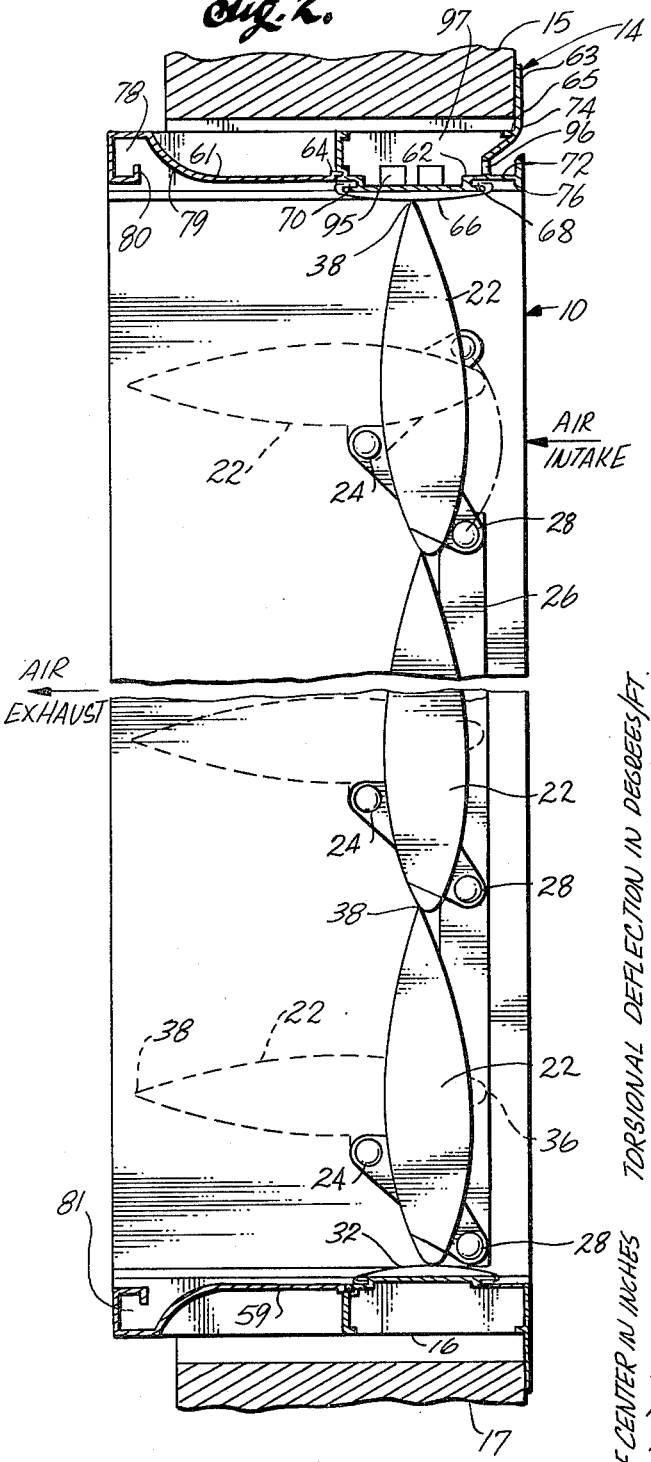
FIG. 2 is a section view of the side of the louver assembly with the blades closed.
Figure 9:
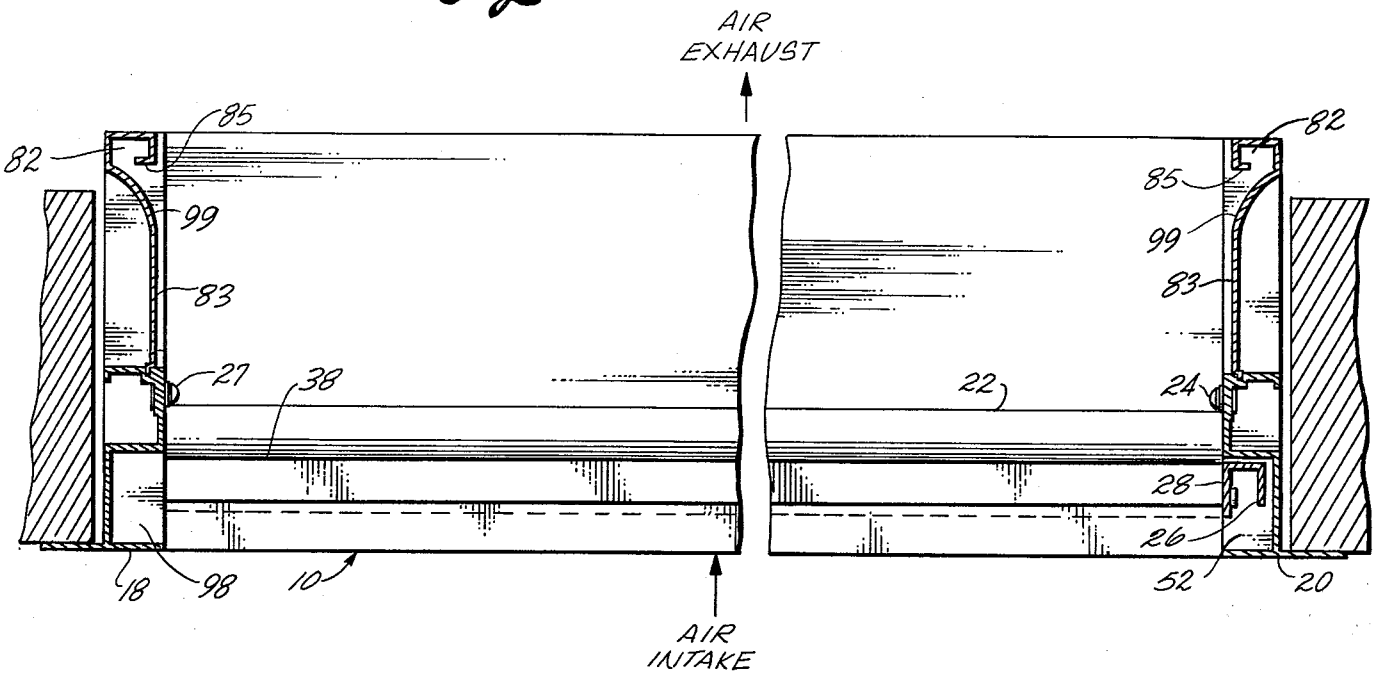
FIG. 9 is a top section view of the louver assembly with the blades closed.

Referring to FIGS. 1, 2 and 9 there is shown in front view, vertical cross section and horizontal cross section, respectively, an adjustable louver blade assembly comprising a rectangular frame 12 having a horizontal top member 14, a horizontal bottom member 16 and vertical side members 18 and 20. The louver assembly has a number of horizontally extending movable airfoil shaped louver blades 22 mounted to the vertical sides 18 and 20. The louver assembly can also be used with the frame horizontal, such as for example over a heat exchanger, however for convenience in description it is assumed that the frame is in the wall of a building or the like for admitting or preventing of admission of ventilation air.

Each of the louver blades 22 in the louver assembly is substantially identical and each of them has a generally symmetrical hollow airfoil cross section having a blunt leading edge 36 and a sharp trailing edge 38 (FIG. 6). The leading edge 36 of each blade is towards the air intake face of the louver assembly when the blades are in a fully opened position and the trailing edge 38 is nearer the air exhaust face of the assembly. Each louver blade is made from a single sheet of uniform thickness aluminum, roll formed or bent into a closed hollow shape with the edges of the sheet welded together to form the trailing edge of the blade. For example, a blade having a chord of about eight inches and thickness of about two inches can be roll formed from hard rolled aluminum sheet about 0.032 inch thick.

To one end of each blade there is attached, preferably by welding, an aluminum blade end piece 40 (FIGS. 3 and 6) that conforms generally to the airfoil contour of the skin of the blade and substantially closes the end of the hollow airfoil. The blade end piece 40 is truncated near the leading edge thereby providing an exit port 47 for discharging water that may be present in the blade in some embodiments as hereinafter described in greater detail. The blade end piece has a blade mounting arm 43 having a blade pivot bearing 24 located therein and a control arm 45 having a control bearing 28 located therein. The blade mounting arm 43 and control arm 45 each extend beyond the outside of the airfoil surface of the blade.

To the other end of the blade is welded a blade end piece 41 which is substantially identical to the blade end piece 40 but having only a blade mounting arm with a pivot bearing 27.

The blade end pieces 40 and 41 serve to strengthen the ends of the blades and to transfer the point loads of the mounting and control bearings to the thin skin of the airfoil cross section shaped blade.

Each of the blades has a pivot bearing 24 located on the control end 40 of the blade and a pivot bearing 27 located on the blade's other end 41. These pivot bearings are located at respective sides of the frame so that the leading and trailing edges of the blade are parallel to the top and bottom of the louver frame. The two pivot bearings are coaxial for mounting the blade for pivoting between open and closed positions. When the blades are in the open position, the chord of the airfoil cross section of each blade is substantially perpendicular to the plane of the frame and when the blades are in the closed position the airfoil chords are approximately parallel to the plane of the frame. In the closed position the chords are not exactly parallel to the frame due to contact between the trailing edge of one blade and a portion near the leading edge of an adjacent blade for tight closing of the louver as seen in FIG. 2. Further, in some embodiments when the blades are in the fully opened position, the chords of the airfoil shaped blades are not quite perpendicular to the plane of the frame to better resist penetration of rain through the louver assembly. In such an embodiment the trailing edges of the blades are tilted upwardly a few degrees relative to the leading edge.

Each blade is mounted to the vertical side 20 of the frame by means of rotary engagement of the blade end piece 40 with a pivot bearing rivet 25 (FIG. 3) secured in a hole 23 through the frame side member 20. The blade end piece 40 has a raised upset boss 35 around the hole through the blade end to provide more support for a bearing sleeve 19 than just the thickness of the frame end piece. The pivot bearing sleeve 19 between the rivet 25 and the boss 35 can be any of a variety of plastic materials to permit low friction pivoting between the blade end and the side of the frame. The sleeve material can be an acetal plastic or acetal filled with polytetrafluoroethylene for lower temperature service while polytetrafluoroethylene filled polyimide can be preferred for higher temperature service. The bearing sleeve is generally spool shaped so that there is a flange between the boss 35 and the enlarged head 25 of the rivet. Similarly there is a flange between the end piece 40 of the blade and the frame side member 20. These flanges serve as spacers and avoid metal-to-metal rubbing. The sleeve is made with a diagonal slit (not shown), that is, a slit approximately in the form of a helix skewed at about 45° from the axis of the sleeve, so that the sleeve can be squeezed to a smaller diameter for assembly and then snapped in place with the flanges on opposite faces of the end piece 40. The end of the pivot bearing rivet extending through the frame side member 20 is upset and enlarged to lock the rivet to the frame side and maintain pivot bearing assembly 24 in place. The assembly holds the blade in rotary engagement with the frame side.

The mounting of the other end of the blade 22 to the opposite vertical side 18 of the frame is by means of rotary engagement of the pivot bearing 27 having a similar construction. Similarly at the control end of each blade the control arm 45 is connected to a control rod 26 by a control bearing 28 of similar construction.

The pivot bearings 24 at the control ends of the plurality of louver blades are spaced apart in a row extending along the height of the frame. Similarly the pivot bearings 27 at the opposite end of each louver blade are also in serial register and are spaced apart the same amount as are the pivot bearings 24 at the control ends of the blades. These pivot bearings 24 and 27 define the pivot axis 24' for the blades for pivoting between the fully opened and fully closed positions. In FIG. 2 the blades are illustrated in solid lines in the closed position with the open position indicated by dashed lines.

The spacing between the pivot bearings is such that in the fully closed position the trailing edge of a blade contacts the adjacent blade near and along its leading edge. Such collective contact between the blades forms a closed surface across the air intake face of the frame thereby interrupting the flow of air through the louver assembly. When in the fully opened position the geometric chord, that is a line between the leading and trailing edges of the blades, is essentially parallel to air flow through the louver assembly.

As mentioned above, a control rod bearing 28 is located at the same end of each blade as is one of the pivot bearings 24. Each control rod bearing is rotatably engaged to the control rod 26 by means of a control rod rivet 30 and bearing assembly similar to the pivot bearing assembly hereinabove described. Each of the louver blades is pivotally engaged with the control rod so that all of the blades can be simultaneously swung to any attitude between fully opened and fully closed by means of essentially liner actuation of the control rod.

Figure 3:
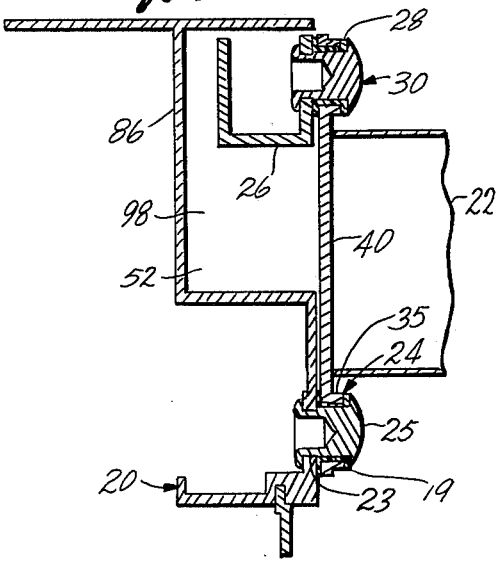
FIG. 3 is a section view of one blade end mounting having pivot and control bearings.

The control rod moves generally upwardly for opening the louver blades towards the opened position illustrated in dashed lines in FIG. 2 and moves generally downwardly from moving the louver blades to a closed position as shown by solid lines in FIG. 2. The pivot bearings and the control bearing 28 are located so that when the control rod 26 is actuated it moves along its length in a vertical direction and each control arm bearing follows a path in an arc having a horizontal component as well as a vertical component, that is, the control rod shifts horizontally as it moves vertically with its maximum horizontal change of position being at the mid point of the stroke between the opened and closed positions. FIG. 3 is a horizontal cross section through the blade end and a frame side member with the blade in an intermediate attitude half way between the fully opened and fully closed positions. The frame side member 20 has a forward extension 86 defining a control rod channel 52 which is large enough that the control rod 26 is free to move through its entire horizontal range without contacting any part of the side frame member 20.

As best illustrated in FIG. 6 the pivot bearing axis 24' of the pivot bearings is located external to the outer surface of the blade 22 and parallel to the length of the blade. The pivot axis intersects a line starting at the center 50 of the airfoil chord 44 and running forward at an angle of about 45° from the chord. "Forward" is defined as the direction from the center 50 towards the leading edge 36 of the louver blade. This can also be referred to as "upstream" of the center of the chord line. The pivot axis is just far enough along the 45° line beyond the outside surface of the blade so that the rivet 25 set in the frame does not contact the airfoil shaped blade surface. Thus, the pivot bearing is located between the center of the chord and the leading edge of the blade, albeit not on a straight line therebetween.

The control rod bearing axis 28' of the control rod bearing 28 is located external to the outer surface of the blade and is on the side of the blade opposite from the pivot bearing axis 24'. The control bearing axis 28' intersects a line that is about 45° from the airfoil chord 44 passing through and forward from the axis of the pivot bearing 24'. The control bearing axis 28' is just far enough on the 45° line beyond the outside surface of the blade that the bearing rivet does not contact the airfoil shaped blade surface.

Air flowing past an airfoil or lifting vane section results in a differential pressure distribution along the upper and lower surfaces of the airfoil. These pressure distributions which are a function of airfoil shape, aspect ratio, air velocity, air density and the angle of attack (angle between airfoil geometric chord and the direction of undisturbed air flow) give rise to aerodynamic lifting forces that act to move the airfoil section in a direction generally at right angles to the approaching air flow.

The pivot bearing location herein described provides stability against what would otherwise be a major mode of vibration or blade fluttering if the pivot bearing were at the center of the chord or on a line perpendicular to the center of the chord as is commonly done in manufacture of conventional louvers.

In the past central location of the pivot bearing has been used since it has the advantage of minimizing the control force required when the blades of the louver are in or near their closed position. This is true since the air pressure acting against the blades is balanced on both sides of the pivot axis when the blades are in their closed position. Since the static pressure difference is a maximum when the blades are closed, and in most applications the static pressure is far greater than the velocity pressure with the blades open, the central placement of the pivot bearing relative to the chord line of the blade generally comes close to minimizing the control force. This is particularly true with conventional flat louver blades where flow separation usually occurs at the leading edge so that the center of force on the blade is near the center of the chord even at low angles of attack.

In a streamlined symmetrical blade shape as herein described, the center of lift on the airfoil is about $\frac{1}{4}$ chord length downstream from the leading edge at moderate angles of attack and shifts rearwardly towards the center of the chord at high angles of attack approaching the angle where the blade is completely stalled, that is where there is a dramatic and sudden decrease in coefficient of lift.

An important set of phenomena takes place with an airfoil shape. The most familiar one is a hysteresis in the coefficient of lift versus the angle of attack curve around the stall point. If the angle of attack is gradually increased the coefficient of lift also continues increasing until the stall point where there is often a sudden discontinuity and the lift suddenly decreases. Once a stall condition occurs with an airfoil, the low coefficient of lift usually continues until the angle of attack has been substantially reduced below the initial stall point before abruptly changing back to a non-stalled condition. This represents a hysteresis loop on a plot of lift coefficient versus angle of attack.

A less known effect is that almost every airfoil will remain unstalled to much higher angles of attack and maintain a high lift coefficient if the angle of attack is rapidly increased, apparently because it takes an appreciable time for sufficient stagnant air to accumulate to cause flow separation and stall. This effect causes hysteresis in the curve of coefficient of lift versus angle of attack for almost any airfoil if it is being rotated rapidly.

Both of these hysteresis effects occur when the center of lift is well forward of the center of the chord of the airfoil, typically about $\frac{1}{4}$ to $\frac{1}{3}$ of the chord length downstream from the leading edge. These hysteresis effects are important, not for the gross magnitude of the difference of forces around the hysteresis loop, but because if the blade is supported by a pivot bearing appreciably downstream from the center of lift they will cause the blade to oscillate. In an adjustable louver system linkage is provided between the several blades by the control rod and the blades therefore tend to oscillate simultaneously in phase. Such synchronous oscillating of the blades can produce a very serious vibration problem.

The reason for the oscillation can be seen by examining the forces on an airfoil pivoted at the center of the chord as the blade is pivoted through the hysteresis region. The effect can occur as the blade angle of attack is near the stalled transition region, and once even slight oscillation is commenced, it can be amplified by the forces around the hysteresis loop. As the angle of attack increases, the lift increases, adding energy to the motion of the blade. As this continues the force of the control rod overcomes the pivoting motion of the blade and the blade comes to a stop. At this moment the kinetic energy of the blade has been turned into potential or strain energy which is transferred back into kinetic energy as the blade swings back. If the lift force retarding the blade swing toward lower angles of attack were identical with the lift force at the same angle as the blade swung upwardly towards higher angles there would be no net energy added to the blade and control system and thus no oscillation. The hysteresis effects mentioned above, however, keep the lift force on the blade while the angle of attack decreases, less than the lift force while the angle of attack is increasing. The difference in the lift forces puts energy into the oscillation as long as the pivot point is behind the center of lift, thus increasing the amplitude of the oscillation.

When the pivot bearing axis is forward of the center of lift the difference in lift forces tends to oppose any oscillation. When the pivot bearing axis is close to the center of lift, there is little torque around the pivot axis and thus little tendency to oscillate. Thus, it is important that the blade pivot axis be near the center of lift or forward of the center of lift to avoid oscillation in the airfoil shaped blades of the louver.

In a preferred embodiment the blade pivot bearing axis is located about $\frac{1}{3}$ chord length downstream from the leading edge (measured to a perpendicular dropped from the bearing center to the chord line). With such a pivot bearing location the pivot axis of the blade is forward of the center of aerodynamic force exerted on the blade for all attitudes of the blade between a closed position and a position about 60° from the closed position. Throughout this range where forces tending to cause oscillation are greatest, all oscillations are effectively damped. At higher angles from the closed position, the pivotal axis of the blade is near the center of aerodynamic force and moments tending to induce oscillation are minimal. It has been found that the inherent damping by friction forces and the like effectively prevent oscillation of the blades at all attitudes between a fully closed and a fully opened position.

Placing the pivotal axis of the bearing intersecting a line through the center of the chord and at an angle of 45° to the chord where the angle is measured from the chord line in the angular direction in which the chord line rotates when moving the blade from the opened position towards the closed position, is important for proper operation of the adjustable louver assembly. When the pivotal axis of the blade is on a line approximately 45° from the chord line, the center of the chord line of each blade is substantially the same distance from an edge of the frame when the blades are in the fully opened position and when the blades are in the fully closed position.

Thus, with the blades in the closed position, as illustrated in solid lines in FIG. 2, the top blade has its trailing edge 38 sealing to the frame by a seal 66 described in greater detail hereinafter. Similarly, the leading edge of the bottom blade seals against a seal strip at the bottom of the frame. The center of the chord of the top blade is the same distance from the top frame as the center of the chord of the bottom blade is from the bottom of the frame.

When such blades are pivoted to a fully opened position as shown by dashed lines in FIG. 2 the center of the chord of the top blade is the same distance from the top of the frame as it was when the blade was in the closed position. The same is true at the bottom. Thus, the space between the top and bottom blades and the frame is the same and air flow through such spaces is equivalent. This minimizes air flow maldistribution and minimizes pressure drop through the louver assembly.

Placement of the control rod bearing 28 on a line running forward from the blade pivot bearing about 45° to and crossing the blade chord on the opposite side of the blade achieves the best possible control rod functioning by moving the louver blade the necessary 90° between fully closed and fully open positions (FIG. 2) while keeping the angle between the control rod and the line between the blade pivot bearing and the control rod bearing between 45° and 90° as the control rod moves between a plus 45° and a minus 45° angle with respect to such a line. Thus, the angle between the control rod and the line between the blade pivot bearing and the control rod bearing is maintained greater than about 45°. Such control rod bearing placement also minimizes the excursion of the control rod in a direction normal to its lengthwise translation, and thus minimizes the width of the offset portion 52 (FIG. 3) of the louver frame containing the control rod and thus minimizes the overall width of the louver frame.

Such placement of the pivot and control bearings is both mechanically and aerodynamically optimum. The distance between the blade pivot bearing and the control rod bearing is the maximum that can be fitted in the side frame without an extra extension which would add to the thickness of the frame. The 45° angle of the bearing-to-bearing line relative to the chord line assures the maximum distance between the bearings in a direction perpendicular to the control rod. Thus the lever arm between the bearings is maximized for the available frame depth, thereby minimizing the force required on the control rod for adjusting the blades.

Aerodynamically it is optimum not only in avoiding oscillation or vibration as previously described but it also results in the frame-to-blade distance for both end blades being equal to one-half the blade-to-blade distance as measured from the outside surfaces of the blades when the blades are in the fully opened position. This has a significant effect in reducing aerodynamic drag or pressure drop through the louver assembly, particularly in small louvers where the area between the end blades and the frame is an appreciable portion of the total area through the louver assembly. Another advantage of placing the bearings external to the hollow blade is that the bearings are easily inserted and replaced and simple semi-tubular rivets can be used rather than blind rivets or threaded fasteners.

Aerodynamic trips 46 and 48 (FIG. 6) are placed along the length of and parallel to the leading edge of the louver blade for the purpose of inducing turbulence or mixing in the boundary layer at the blade's outer surface. The louver blades of the device described herein have a thickness in the order of two inches and a chord length in the range of about eight inches. When multiple blades are used in a louver assembly, the louver blades are spaced approximately eight inches apart, so that the space between the rear portions of the blades (i.e. aft of the thickest part of the blades) forms an aerodynamic diffuser section when the blades are in their fully open position. The width of the diffuser increases from six inches to eight inches in a distance of about four inches. Thus, forming an included angle of about 28°, which is too high for air flow to adhere to the outer surface of the blades, particularly at low Reynolds numbers generated by air velocities in the range of about 500 to 2,000 ft/min. Separation of the flow from the surface increases aerodynamic drag.

Aerodynamic trips such as raised regions or knurls embossed in the blade improve aerodynamic performance and in the preferred embodiment a ridge embossed on each side of the blade about one and one-half to two inches behind the leading edge of the blade has proven to be most effective. Preferably the means for inducing turbulence or mixing in the boundary layer at the surface of the airfoil is located aft of the leading edge of the blade about 1/5 of the length of the chord of the airfoil. The aerodynamic trips should be forward of the thickest part of the blades. This places them in the converging portion of the space between adjacent blades. It appears that the aerodynamic trip so located causes turbulent flow in the region adjacent to the airfoil surface and inhibits boundary layer separation in the diverging diffuser portion.

Whenever an object is placed in a moving fluid, it will experience a force in the direction of the motion of the fluid relative to the object (drag force) and it may experience a force normal to the flow direction (lift force). The drag and lift forces are caused by the sum of the tangential and normal forces acting at the surface of the airfoil. The drag, due to tangential forces is called friction, skin friction, or viscous drag. The drag due to normal forces is called pressure drag. Pressure drag is more important and often dominant for an airfoil. Since the air flowing past the airfoil is not frictionless, a boundary layer about the airfoil is created in which air flow velocity is lower than in the balance of the space between the blades. The boundary layer grows more rapidly for an adverse (retarding flow) pressure gradient along the blade and if the pressure gradient is large enough, separation of the air flow from the blade may occur. The resultant large turbulent wake aft of the trailing edge of the airfoil results in a lower pressure than would be obtained for frictionless flow. This reduced pressure in the diffuser or diverging portion of the space between the airfoil blades results in a net force in the direction of the flow as well as causing dissipation of energy within the air flow.

In order to reduce pressure drag, it is necessary to reduce the magnitude of the adverse pressure gradient over the trailing edge of the louver blade and to prevent or delay separation of the air flow if possible. To minimize the pressure drag, turbulent flow is induced in the boundary layer about the airfoil by means of the aerodynamic trips 46 and 48. This turbulence energizes the boundary layer by mixing higher velocity air into the boundary layer so that it has enough energy to overcome the adverse pressure gradient. Other means for mixing higher velocity air into the boundary layer can also be used, such as wedges or small vanes called vortex generators projecting from the surface and set at an angle to the flow. The embossed ridges have been found to work quite well and are simple to fabricate without adding weight or complexity. As a result, there is a significant decrease in the drag coefficient because the point of separation of the air flow is delayed, resulting in a lower pressure drag and thus lower total drag. Lowering the total drag thereby lowers the amount of energy that must be supplied to an air stream that is to pass through the louver blade assembly, in order to achieve a predetermined flow rate of air through the assembly. In addition, lowering the pressure drag across the louver blade reduces the force in the direction of the motion of the fluid relative to the blade, thereby minimizing the stress at the pivot axis required to oppose the resulting drag force.

The louver blades herein described have, for example, a thickness of about two inches and a chord length of about eight inches, and thus the maximum thickness of the blade is about 25% of the chord. Such thick blades are employed for enhancing the rigidity of the blade and minimizing lateral and torsional deflections. This rigidizing comes about from the curvature of the skins of the airfoil shaped blade and also due to the separation of the two surfaces of the blade. These two factors cooperate to significantly increase the torsional rigidity and lateral buckling strength of the blade.

If such a thick blade is isolated and immersed in an air flow, drag due to boundary layer separation may not be any significant factor. However, when such thick blades are spaced apart about one chord length there is interference in the air flow between the blades and there is much more change in drag than there is for a single isolated blade. The addition of aerodynamic trips as herein described significantly reduces the boundary layer separation and drag in the space between adjacent blades.

The aerodynamic trip locations in the converging portion of the space between the blades bring the pressure drop through the louver assembly down from about 18% of the velocity pressure to about 6½% of the velocity pressure, at an air velocity of approximately 1100 ft/min. Pitot-static tube scans of the trailing edge of the blade demonstrate that the trips function by keeping the air flow from breaking away from the blade until the flow is near the trailing edge, showing therefore a delay in the boundary layer separation point. Graphical illustration of the static pressure drop for conventional louver blades as compared to that of the blades constructed according to principles herein described is presented in FIG. 8. At a minimum, the decrease in pressure drop is in a ratio of 5 to 1 for the airfoil louver blade over conventional blades when considering air flow velocities in the range up to about 5,000 ft/min.

Figure 12:
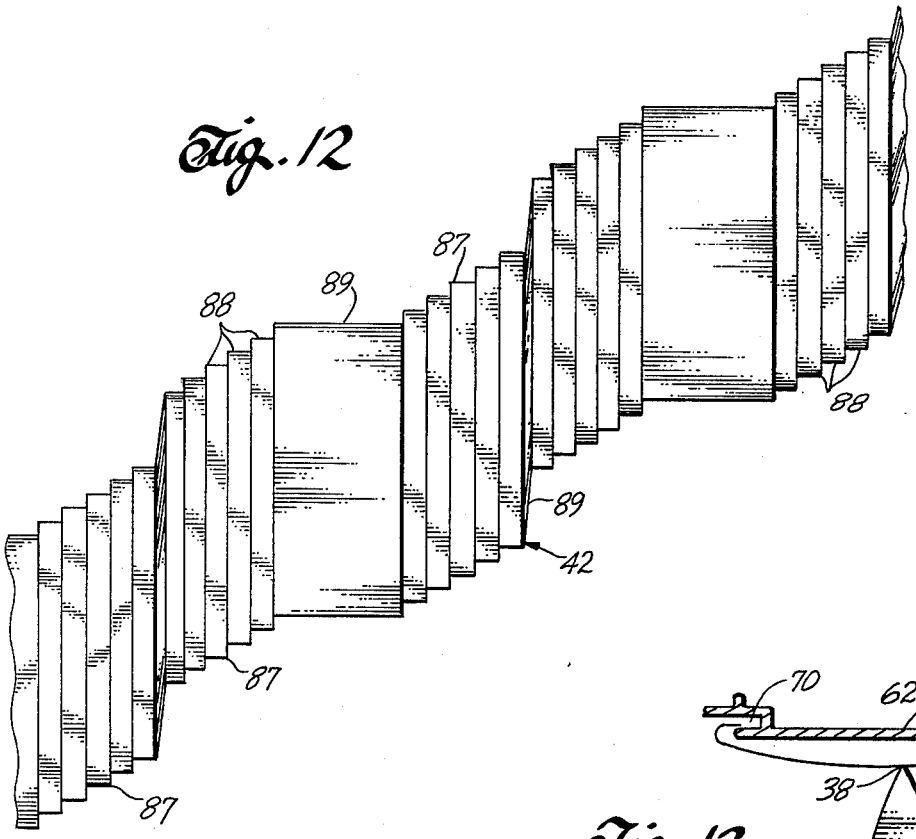
FIG. 12 is a perspective view of the spacer ribbon.
Figure 13:
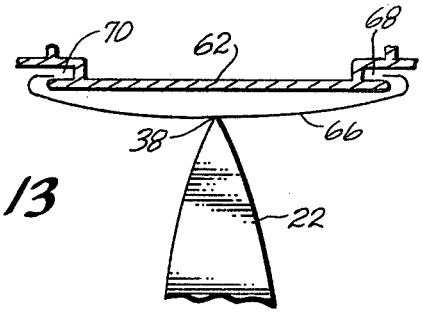
FIG. 13 is a detail of a top or bottom seal.

Positioned between and frictionally contacting the inside surfaces of the louver blade is a reinforcing or spacer strip 42 (FIGS. 6, 11 and 12). The spacer strip, formed of a ribbon of hard aluminum, having a thickness of about 0.005 inches has the general shape of a periodic wave along its length and in the preferred embodiment, the convolutions are in the general shape of a trapezoidal wave. The parallel sides 87 of the trapezoidal wave have a plurality of zig-zag corrugations 88 extending along the length of the ribbon. The zig-zag corrugations in a preferred embodiment are right angle bends with the lengths of straight portions between the bends being about 0.1 inches. The period of the wave is about two inches. The length of each of the parallel corrugated sides is less than one inch, and the width of the strip is somewhat less than two inches.

The length of the strip is selected so that the strip extends between the two ends of the blade and the width of the strip is selected so that it is about the same as the maximum width of the blade. Therefore the ribbon frictionally contacts the inner surfaces of the blade along both parallel sides of the trapezoidal convolutions. The width of the strip can be slightly greater than the "as formed" thickness of the blade so that the skins forming the surfaces of the airfoil blade are forced apart slightly by the spacer ribbon. This assures a tight frictional fit for the spacer strip.

The spacer ribbon forms a web between the inside surfaces of the hollow airfoil and resists deflection of the airfoil in a direction transverse to the plane containing the chord of the airfoil. Blade deflection can occur due to aerodynamic loading when the blades are open or partly open and by pressure differences when the blades are closed. Excessive transverse load can result in buckling of the blades and the web between the inside surfaces effectively resists such buckling by preventing collapse of the blade.

The spacer strip is in the form of a ribbon of sheet metal having a thickness substantially less than the thickness of sheet metal forming the blade. This web is corrugated with the corrugations progressing along the length of the blade and extending in a plane normal to the plane of the airfoil chord. The corrugations are in groups 87 and consecutive groups are alternately on opposite sides of a plane normal to the plane of the airfoil chord and extending along the length of the blade through the thickest part of the blade.

The width of the ribbon is slightly less than the maximum thickness between the two sides of the airfoil when the strip is in place. The sides of the airfoil converge both fore and aft of the thickest part, hence the corrugations 88 have at least their crests in frictional engagement with the inside surfaces of the blade. An intermediate portion 89 of the ribbon between the two groups of corrugations extends across the plane through the thickest part of the blade and since it is slightly narrower than the thickness of the blade this intermediate portion may not be in frictional engagement with the blade. In an illustrative embodiment of such a blade the strip used for forming the web has a width of about two inches. The space between the inside surfaces of the blade is about 1½ inches when the web is not in place. Inclusion of the web springs the sides of the blade outwardly to give it a thickness of about two inches. By making the strip wider than the space between the inside surfaces near the thickest part of the blade, the strip can be mounted within the hollow interior of the blade and held in place by frictional contact with the interior walls. Although an adhesive can be added to enhance the frictional engagement, it does not appear necessary.

The ends of the zig-zag corrugations 87 bearing against the interior walls of the blade provide more surface contact area between the spacer strip and the blade than is possible with a spacer strip not having such corrugations. The spacer strip is in compression loading when the blade is transversely deflected and the zig-zag corrugations resist buckling of the thin web. The periodic crossing of the plane through the thickest part of the blade helps hold the strip in place and upright between the sides. This greatly enhances resistance to blade bending or deflection due to the effects of aerodynamic force on the blades or due to the force exerted by the control arm when the blades are set to a fully closed position.

In the preferred embodiment, the spacer strip extends through the entire length of the blade in order to maximize blade reinforcement. The spacer strip width is made larger than the blade width at a desired point of contact on the interior surface of the blade so that the strip is frictionally clamped between the blade's inner surfaces at the time of the blade's fabrication. While only adding approximately 2½% to the weight of the blade material, the spacer strip almost doubles the maximum moment tending to bend the blade that the blade will withstand prior to buckling. The spacer strip allows use of thin sheet aluminum for the skin of the airfoil while maintaining blade strength and rigidity. The uniform width of the spacer strip also helps hold the maximum thickness of the blade within reasonable tolerances.

The airfoil shaped blade including the spacer strip and aerodynamic trips realizes several significant advantages over single thickness extruded blades due to the increase in blade strength, the larger cross-sectional moment and the decrease in air resistance resulting from the airfoil shape. The blade realizes a five times improvement in the flexural rigidity, approximately a 60 times improvement in its torsional rigidity, a reduction to about one-fifth of the air resistance and a 33% reduction of material use as compared to presently available blades.

Figure 4:
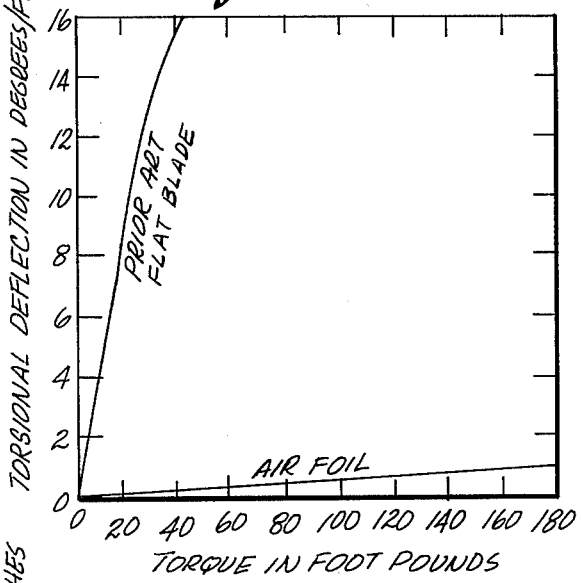
FIG. 4 is a graph of torsional deflection of a blade versus torque applied to such a blade.

FIG. 4 is a graph of the torsional deflection of a blade, measured in degrees deflection per foot versus applied torque measured in foot pounds, for both a typical flat extruded blade having a skin thickness of 0.080 inches, a chord length of eight inches and a blade length of four feet, and a symmetrical airfoil shaped louver blade constructed according to principles herein described, and having a skin thickness of only 0.032 inches, a blade maximum thickness of about two inches, a chord length of eight inches, and a length of four feet. Comparison of the slope of each curve reveals that the torsional rigidity of a blade as described herein is in the order of 60 times greater than that for a flat louver blade weighing about ¼ more than the airfoil louver blade. Such torsional rigidity of the airfoil shaped louver blade permits fabrication of blades of lengths far greater than those presently available. Such increased torsional rigidity permits fabrication of louver systems with individual blade lengths in the order of 16 feet while also permitting control of such long blades from one end only.

Figure 5:
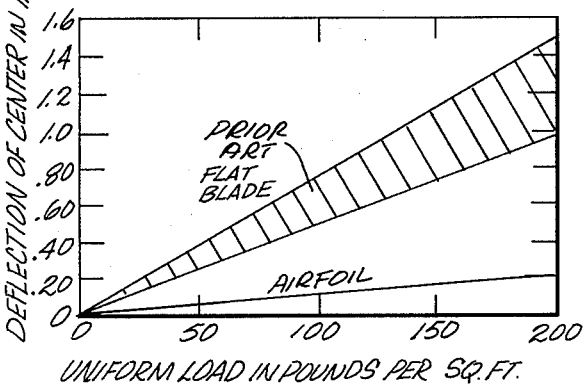
FIG. 5 is a graph of deflection of the center of a blade versus uniform load applied to the blade.

FIG. 5 is a graph of the deflection, measured in inches, of the center of the louver blade as a function of uniformly distributed load measured in pounds per square foot that is applied transverse to the chord of the blade for both conventional extruded blades having a length of four feet, a skin thickness of 0.080 inches, and a chord length of eight inches, and a symmetrical airfoil blade constructed according to principles herein described, and having a skin thickness of only 0.032 inches, a blade thickness of two inches, a chord length of eight inches, and blade length of four feet. Comparison of the slopes of the curves reveals that the deflection resistance of an airfoil blade as herein described is at least five times greater than that for presently available flat blades. The increased rigidity of the airfoil shaped blade minimizes blade deterioration from stress fatigue by minimizing the amount of blade deformation due to torsional and lateral deflections. Additional strength characteristics are provided by use of sheet metal such as hard rolled aluminum for the louver blade due to its weight versus strength characteristics.

The force required to form a tight seal of the louver blades in the fully closed position as well as the accumulative effects of the aerodynamic forces previously described that act upon the blades, are transmitted by means of the blade end 40 and control rod bearing 28 to the control rod 26. The resultant tensile stresses within control rod 26 are cumulative so that the stress is greatest nearest the control rod actuator and smallest at the control rod bearing of the farthest blade from the actuator. Compensation for the progressively increasing tensile elongation of the control rod due to the increase in tensile loads is provided by slightly and progressively decreasing the distance between adjacent control rod bearing locations on the control rod 26 such that the distance between adjacent control rod locations is smallest nearest the control arm actuator. Tensile elongation cancels the progressively decreasing spacing near the actuator so that when the control rod is fully loaded in tension, the spacings are about equal. Reaction to the stress loading will thereby cause the blades to close uniformly along the height of the louver frame, providing uniform closure contact and air sealing between the leading and trailing edges of abutting blades. Likewise in an embodiment where the louver is closed by pushing on the opposite end of the control rod, the spacing between the bearings nearer the actuator is progressively increased to compensate for elastic compression of the control rod. Such variation of control bearing spacing along the length of the control rod is beneficial in an embodiment where the pivot bearing is between the leading edge and the center of the chord since the force needed for closing the louver against a pressure head is greater than when the pivot bearing axis is near the center of the chord. Tight and uniform closing between all of the blades in the louver assembly is thereby assured.

Additional air sealing between the leading and trailing edges of abutting blades is provided by a blade seal strip 54 (shown only in FIG. 6 and deleted from other drawings for clarity). The edge seal strip is generally J-shaped in transverse cross section with the longer leg of the J bonded to one surface of the blade and the other shorter leg 58 of the strip hooked over the trailing edge 38 of the blade. The seal strip is secured to the blade 22 by means of a glue such a hot melt adhesive or chlorofluoro-ethylene which can be melted on by a hot roller process. Alternatively the strip can be ultrasonically welded to the surface of the blade. The longer leg of the J-shaped edge sealing strip 54 is pre-bent to spring away from the blade trailing edge but is restrained by the fold over hook 58 which contacts blade edge 38. Such spring loading and restraint of the seal strip against the blade edge prevents the seal from vibrating due to air flow over the blade edge when the louvers are in an open position. It also minimizes the distance the seal must protrude from the blade surface to seal a given gap with a given force per unit length since the hook retains the pre-sprung portion of the strip from springing about twice as far out from the blade. Use of an elastic material, preferably hard rolled sheet aluminum, having a thickness of about 0.005 inches avoids the permanent deformation characteristic of seals made of materials such as rubber when undergoing compression stressing during prolonged blade contact. Use of material such as sheet aluminum in this configuration requires only doubling the force necessary to completely close the seal over that force required to initially move the seal. Elastomers or plastics can be used as a seal where excessive mechanical abuse is likely.

The glue between the seal strip surface and the surface of the blade experiences no more than slight tensile stress due to the flexibility of the seal strip, thereby minimizing any tendency of peel or parting of the seal strip at the glue interface. The edge where the glue surface ends and the seal strip extends towards the trailing edge is always under compression stress, thereby minimizing any tendency for glue cracking or peeling.

Figure 7:
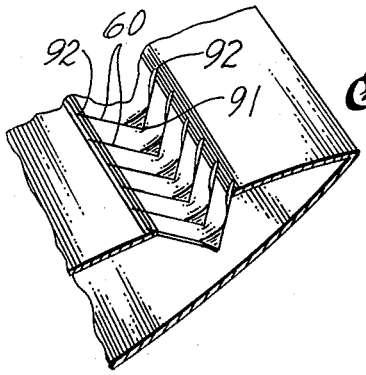
FIG. 7 is a fragmentary perspective view of slits for admitting water to the inside of a hollow blade.

Referring now to FIGS. 6, 7 and 10, each louver blade 22 has a plurality of generally chevron shaped slits 60 in a row 62 along and parallel with the trailing edge 38 of the blade and another plurality of chevron shaped slits in a row 64 extending along the length of the blade near the leading edge 36 of the blade. The overlapping chevron shaped slits can be formed by a continuous punching technique on the roll forming line used to form the hollow airfoil blade. The chevrons can be punched by a male die without the necessity of a closely fitting female die and a simple mating grooved roller can be positioned beneath the die to provide back support during the punching process.

Each of the rows of chevron shaped slits is along the upper surface or nose of the blade when the blade is in its opened position and provides a permeable region extending along the length of the blade for admitting water through the blade skin from the outside of the blade to the hollow interior of the blade. Such a permeable region near the trailing edge of the blade intercepts water flowing along the upper surface of the blade towards the trailing edge so that the water enters the hollow blade and does not stream off the trailing edge. The row of holes 62 near the trailing edge is about one inch or less from the trailing edge. The similar row of holes 64 near the leading edge of the blade also admits water from the outside of the blade to the hollow inside, thereby intercepting water flowing downwardly near the leading edge and minimizing dripping from the blade or streaming along the lower surface of the blade. The holes in the row 64 near the leading edge are as close to the leading edge as convenient without disturbing the bend of metal at the leading edge. For example, in an illustrative embodiment, the edge of the row of slits is only about $\frac{1}{8}$ to 3/16 inch from the leading edge of the blade.

The holes through the blade are in the form of chevron shaped slits wherein each of the slits has a tip pointed towards one end of the blade and nested with an adjacent chevron shaped slit so that the tip 91 of one chevron shaped slit extends across a line between the wings 92 of the adjacent chevron shaped slit. For example, in one embodiment the slits are about $\frac{1}{8}$ inch apart and have a total width between wings of about $\frac{3}{8}$ inch. The included angle at the tip is about 90°. Because of the overlapping of slits there is no straight line from the leading edge of the blade to the trailing edge that does not intersect at least one slit. The slits are therefore effective in intercepting water flowing across the surface of the blade.

The tips of the generally triangular tabs of sheet metal severed by the chevron shaped slits are bent inwardly into the inside blade so as to guide water passing through the slit downwardly into the inside of the blade. When bending the tabs of metal between the chevron-shaped slits inwardly from the outside surface of the blade to point into the inside of the blade a generally V-shaped trough is created in the upper surface of the blade along the row of chevron shaped slits. For example, such a trough can be about $\frac{3}{8}$ inch wide (the full width of the row of slits) and extend about $\frac{1}{8}$ inch below the airfoil surface of the blade. The slits form holes along the bottom of the trough which also serves to help direct water flowing along the surface of the blade from the outside to the inside of the blade.

Rain water or any moisture condensate in the louver air intake stream which collects on the upper surfaces of the blades will flow along the upper surface, and be directed to the slits , down the slit edges and into the hollow blade interior. It is believed that the chevron-shaped slit edges act to lead the water down into the blade by surface tension forces until sufficient gravitational head is developed in the water droplets to cause the water to drip off the tips of the metal tabs and into the blade. The spacer strip 42 within the hollow blade substantially blocks air flow through the blade from the slits in the front row 64 to the slits in the back row 62 and prevents inadvertent blowing of water from the inside of the blade through such slits to the outside. If desired a permeable material such as metal felt or glass cloth can be applied in or over the trough to help direct water from the outside to the hollow interior of the blade and maintain a smoother aerodynamic shape on the outside of the blade. Other hole configurations can be used in such an embodiment. When the permeable region through the skin of the blade extends into the blade further than the thickness of the sheet metal skin, a gravitational head can develop to cause water droplets to fall into the hollow interior of the blade. A region of limited permeability can thereby convey substantial quantities of water from the outside of the blade to the hollow interior thereof.

The exit ports 47 at each end of the blade provide drainage for such water entering into the hollow blade interior. Additional drainage openings can be provided in the hollow blade ends if desired. Thus, the hollow blade prevents water from being entrained in the air stream and conducts such water to the blade end exit port through the inside of the blade where it is not exposed to air flow through the louver assembly or to spattering by impact of rain. When the blades of such a rain resistant louver are in the fully open position, they can be tilted slightly to minimize entrainment and aid discharge of water. Thus, for example, the trailing edge can be tilted about 5° to 15° above the leading edge. The water discharge ports are preferably near the leading edge in such an embodiment.

The chevron slits of the preferred embodiment also act as stiffeners to increase the blade surface stiffness in the circumferential direction. The bending of the tabs of metal between adjacent chevron-shaped slits into the inside of the blade actually stiffens the skin of the blade in the region of the slits such as stiffening rib strengthens a sheet. Such reinforcement of the skin of the airfoil shaped blade is preferable to the weakening that could be encountered by punching holes through the surface of the blade with consequent removal of metal. Such rows of holes can be used with addition of a reinforcing "doubler" on the skin of the blade.

The chevron shaped slits are provided in the upper surface of the blade on which substantially all rain water impinging on the louver might collect. The effect of forming the slits on only one surface can introduce slight asymmetry into the airfoil shape of the blade but the effect is too small to have any substantial effect on the operation of the louver assembly except for a slight increase in pressure drop through the louver assembly. The resulting pressure drop remains quite small in comparison with other rain resistant louvers due to their extremely poor aerodynamic shapes.

Referring again to FIG. 2, there is shown in side view a typical installation of the louver assembly in a supporting wall structure. The louver is supported at its top by a supporting wall 15 and the louver is supported at the bottom by a supporting wall 17. The top part of the louver assembly includes an upper frame member 62. In a rain resistant embodiment a top louver extension 61 is connected to the upper frame member 62 by a louver extension flange 64 that is inserted in a corresponding channel in the upper frame member 62. The upper frame member also includes a louver alignment flange 63 that aligns the louver assembly 10 with the supporting surface 15 and also covers any irregularities in the opening in the wall. A louver top bracing lip 65 serves to hold a sealant or weather stripping in place.

The upper frame member 62 has a forwardly facing recess 68 and a rearwardly facing recess 70 to receive the folded back edges of a smoothly curved upper seal 66. The upper seal 66 is made up of resilient, flexible material and in the preferred embodiment is hard rolled aluminum sheet with a thickness of approximately 0.005 inches. Extruded plastic or elastomer strips can also be used. The upper seal serves to prevent air flow between the top of the louver frame and the uppermost louver blade in the assembly. The seal is so positioned within the arc of closure of the upper louver blade that, upon closure, the trailing edge of the blade contacts and lightly deforms the seal to maintain a closed surface relative to the seal and the blade, thereby preventing air flow between the two members. The ends of the top seal 66 are folded over and placed within the channels or recesses 68 and 70, such that the ends of the seal are free to move within the channels as contact pressure is applied to the seal when the louver blade is closed and thereby in contact with the seal. The folded over bends are such that for any contact, the seal will remain slidably secured within the channels. A bottom seal 32 contacts the leading edge of the lowest blade and functions similarly to that just described.

A wall trap or gutter is built into the top frame member of the louver assembly to conduct water flowing down the outside supporting wall to the side of the louver so that the water does not drip from the top frame structure of the louver onto the louver blades and thus be blown within the building.

Slots 96 are cut in the partition between the gutter and an inside channel 97 within the upper frame member. This permits water from the gutter to also flow along the channel 97 which has a much larger cross section than the gutter and provides an additional conduit for water, thereby greatly enhancing the capability of the wall trap for handling heavy rains without overflow of the gutter. Any excess water passes through the slots from the gutter into the internal channel to provide adequate area for water flow without requiring a costly hollow extrusion or thick wall sections in the top frame member.

Hollow rectangular corner conduits 84 are connected by apertures 95 to the ends of the wall trap gutter and the top channel 97 so that water flowing along the gutter and top channel is guided into the hollow conduits. The corner conduits discharge the water to vertically extending side channels 98 (FIGS. 2 and 3) in the side members of the frame through holes (not shown) in the bottom of the corner conduit. After flowing down the side channel 98 the water flows through an opening (not shown) into a hollow bottom corner conduit 84 and thus to the external face of the louver assembly. Such water can discharge to the exterior of the structure or into suitable drains. The square corner conduits are welded to the respective frame members for interconnecting the corners of the louver assembly.

The upper part of the wall trap gutter 72 has a smoothly rounded entry curve 74 at the top to guide water streaming down the wall 15 of the building to the wall trap gutter. The smooth roundness of the curve helps make the water follow the surface, thereby minimizing the potential of dripping along the surface and maximizing the collection rate of the fluid in the gutter. The arrangement of gutter and internal channel at the top frame member with a smoothly curving entrance to the gutter permits the louver assembly to be mounted with its face flush with the wall of the structure in which the louver assembly is mounted.

Any liquid not transported by the gutter 72 is directed by means of a drip lip 76 to the exterior of the louver frame and as near as possible to the intake face of the louver assembly. The drip lip 76 has a very narrow and sharp lower edge, and water droplets falling from such a narrow and sharp edge are not blown back as far into the louver intake as are falling raindrops or water that falls from surfaces with blunt or fairly rounded edges, probably due to the downward motion and high velocity of the air at the edge.

Any water falling on the lower louver extension 59 is guided into a gutter 81 near the air exhaust face of the louver assembly. Water from the bottom gutter 81 discharges into the square hollow corner conduits 84 (FIG. 1) at the lower sides of the frame. These corner conduits are closed at the face of the louver assembly inside the structure and open at the opposite face for discharging water outside the building.

In FIG. 9 there is shown in top view the louver assembly 10 having louver side extensions 83 connected to the side frame members 18 and 20 much like the top louver extension 61 is connected to the upper frame member.

Each side extension has a water channel 82 running vertically near the air exhaust face of the louver assembly and open on the side facing the air intake face of the assembly for conducting water downwardly along the side of the frame. There is a smoothly curving surface 99 between the side channel and the air intake face of the louver assembly for conveying water into the side channel. The smoothly curving surface minimizes separation of water droplets and helps assure that water flows into the side channel 82 to be carried to the bottom of the frame. The side channel includes a hook-like reentrant lip 85 extending outwardly relative to the frame and spaced apart from the air exhaust face of the frame to give the side channel a generally G-shaped horizontal cross section. It has been found experimentally that the hook-like lip 85 helps keep water from being blown back into the airstream through the louver assembly, apparently by turning back water that attempts to splash out. It will be noted that the top, bottom, and side louver extensions are the same in cross section, hence all can be made from the same aluminum extrusion.

Water carried down each of the side channels 82 runs into an aperture (not shown) in a corner conduit 84 in the bottom corner of the frame for discharge on the outside of the building. The side channels 82 can aid appreciably in collecting water blown back along the frame sides by high wind or overflowing from the side channels 98 in a heavy rain, thereby minimizing entrainment of such water in the airstream through the louver. Although the channel 78 in the top extension does not collect water during use of the louver assembly, appreciable quantities of rain water can be conveyed away from the louver assembly by the side channels 82 and bottom channel 86 during a heavy storm.

Although one embodiment of adjustable louver constructed according to principles of this invention has been described and illustrated herein, many modifications and variations will be apparent to one skilled in the art.

Thus, for example, an adjustable louver can be constructed with alternate blades being controlled at the opposite ends of the blades. Half the blades can then be swung downwardly from their opened position to the closed position and the other half of the blades swung upwardly. The blades then meet nose to nose and tail to tail for closure of the louver. Some advantages in controlling air flow through the louver at positions between fully opened and fully closed can be achieved in such an arrangement.

The illustrated embodiment has air flow from the outside of the structure to the inside. Reversal of parts permits air flow from inside to outside.

In the embodiment herein described and illustrated the spacer strip frictionally engaged between the inside surfaces of the blade has alternate portions on opposite sides of a plane normal to the plane of the chord of the airfoil and extending along the length of the blade through the thickest part of the blade. Other arrangements can be employed for the reinforcing web in the hollow blade. Thus, for example, two ribbons of thin sheet metal can be periodically connected together so as to stand up within the blade much in the manner of the trapezoidal wave herein described. All that is needed is a web having reasonable buckling resistance and sufficient width to keep from falling over within the interior of the blade. For another example, a three ribbon composite resembling corrugated cardboard on a portion of metal honeycomb can be stood up within the thick part of the blade in the same general manner as the spacer ribbon described above.

This development has been described in the context of a louver in the vertical wall of a building through which ventilation air passes. Such a structure can in some embodiments have fixed rather than adjustable blades. Similarly the louver assembly can be mounted in a horizontal or tilted surface for passage of air or can be used for exclusion or control of air flow, rain or sunlight. Louvers as used herein refers to the class of multiple blade devices commonly called louvers, dampers, rain or storm louvers, solar shades or blinds, and many additional terms referring to multiple blade devices for controlling the volume of fluid passage or limiting passage of light or fluid.

Many other modifications and variations will be apparent to one skilled in the art and it is therefore to be understood that within the scope of the appended claims this invention can be practiced otherwise than as specifically described.

What is claimed is:

1. An adjustable louver assembly comprising:

a rectangular frame;

a plurality of blade pivot bearing means aligned along opposite sides of the frame;

a plurality of elongated louver blades having an airfoil shaped cross section mounted in the frame, each blade having a leading edge and a trailing edge;

an unobstructed air flow space between each pair of adjacent blades and between each end blade and the adjacent edge of the frame when the chords of the blades are normal to the plane of the frame;

at least one end of each such blade having a blade pivot bearing connected to such a bearing means, such a blade pivot bearing having a pivot axis parallel to the leading edge of the blade located external to the outer surface of the blade and intersecting a line starting at the center of the airfoil chord and running toward the leading edge at an angle of about 45° from the airfoil chord, said pivot bearing located on one side of the chord between the leading edge and the center of the chord;

a control rod bearing on at least one end of each blade with an axis located external to the outer surface of the blade on the opposite side of the airfoil chord from the pivot bearing and forward of the pivot bearing; and control means connected to the control rod bearings for controlling the attitude of the blades.

2. The adjustable louver assembly according to claim 1 wherein the axis of each control rod bearing is parallel to the leading edge of the blade and intersects a line that is at an angle of about 45° from the airfoil chord and passes through the axis of the pivot bearing.

3. An adjustable louver assembly according to claim 2 wherein the control means comprises a control rod pivotally secured to each of the louver blades at the control rod bearing to pivot the blades substantially 90° between a closed position and an open position while maintaining the angle between the control rod and the line between the blade pivot bearing and the control rod bearing greater than about 45°.

4. An adjustable louver assembly according to claim 3 wherein the control rod comprises a plurality of control rod bearing means aligned along the length of the rod to pivotally engage the corresponding control rod bearings, the spacing between the bearing means being progressively varied along the length of the rod to compensate for longitudinal strain of the control rod for closing the blades symmetrically and with substantially equal force exerted on each blade.

5. An adjustable louver assembly comprising:

a rectangular frame;

a plurality of louver blades pivotally mounted in the frame, each blade fabricated of a single piece of uniform thickness sheet metal in the general shape of a closed hollow airfoil;

a blade pivot bearing having its axis parallel to the leading edge of the airfoil, located external to the outer surface of each such blade and at a distance aft of the leading edge of the blade equal to about $\frac{1}{3}$ of the chord of the airfoil;

a control rod bearing having its axis parallel to the leading edge of the airfoil, located external to the outer surface of the blade and positioned between the leading edge and the center of the airfoil chord and on the opposite side of the blade from the pivot bearing;

control means connected to the control rod bearings for controlling the attitude of the blades between an open position and a closed position;

a plurality of openings through at least one surface of each of the blades in a row near the leading edge of such blade for receiving liquid impinging on such blade; and means at at least one end of each of the blades for discharging liquid from the interior of such a blade.

6. An adjustable louver assembly according to claim 5 wherein the openings are generally chevron shaped slits in a row extending along the length of the blade.

7. The adjustable louver assembly according to claim 6 wherein the tips of the tabs of metal adjacent the slits extend into the hollow blade to guide liquid on the surface of the blade down the chevron shaped slits and into the hollow blade.

8. The adjustable louver assembly according to claim 5 wherein the control means comprises a control rod pivotally secured to each of the louver blades at the control rod bearing to pivot the blades substantially 90° between a closed position and an open position while maintaining the angle between the control rod and the line between the blade pivot bearing and the control rod bearing greater than about 45°.

9. An adjustable louver assembly comprising:

a rectangular frame;

a plurality of louver blades pivotally mounted in the frame, each blade fabricated of a single piece of uniform thickness sheet metal in the general shape of a closed hollow airfoil;

a blade pivot bearing having its axis parallel to the leading edge of the airfoil, located external to the outer surface of each such blade and at a distance aft of the leading edge of the blade equal to about $\frac{1}{3}$ of the chord of the airfoil;

a control rod bearing having its axis parallel to the leading edge of the airfoil, located external to the outer surface of the blade and positioned between the leading edge and the center of the airfoil chord and on the opposite side of the blade from the pivot bearing;

control means connected to the control rod bearings for controlling the attitude of the blades between an open position and a closed position;

a plurality of openings through at least one surface of each of the blades in a row near the trailing edge of such blade for receiving liquid impinging on such blade; and means at at least one end of each of the blades for discharging liquid from the interior of such a blade.

10. An adjustable louver assembly according to claim 9 wherein the openings are generally chevron shaped slits in a row extending along the length of the blade.

11. A louver assembly comprising:

a frame;

a plurality of elongated airfoil shaped blades mounted in the frame for pivoting between open and closed positions; and an aerodynamic trip on each surface of the airfoil and extending along the length of the blade at a location aft of the leading edge about 1/5 of the length of the chord of the airfoil for inducing turbulence in the boundary layer of air flowing past such a surface of the airfoil and lowering total drag through the louver assembly relative to total drag in absence of such aerodynamic trips.

12. A louver assembly as recited in claim 11 wherein each aerodynamic trip comprises a raised ridge extending along the length of the blade parallel to the leading edge of the blade.

13. A louver assembly as recited in claim 11 wherein each of the blades has a substantially symmetrical airfoil shaped cross section and comprising an aerodynamic trip in the form of a raised ridge extending along each surface of the airfoil parallel to the length of the blade between the leading edge and the thickest part of the blade.

14. A louver assembly as recited in claim 13 wherein the thickest part of the airfoil blade has a thickness about $\frac{1}{4}$ of the length of the chord of the airfoil.

15. A louver assembly comprising:

a rectangular frame;

a plurality of elongated substantially symmetrical airfoil shaped blades mounted in the frame, each blade having a leading edge and a trailing edge; and each blade comprising an aerodynamic trip on each surface of the airfoil between the leading edge and the thickest part of the blade for inducing turbulence in the boundary layer of air flowing past such a surface of the airfoil shaped blade and lowering total drag through the louver assembly relative to total drag in absence of such aerodynamic trips.

16. A louver assembly as recited in claim 15 wherein each such aerodynamic trip comprises a raised ridge extending along the length of the blade parallel to the leading edge.

17. A louver assembly as recited in claim 15 wherein each such blade is fabricated of a single piece of uniform thickness sheet metal in the general shape of a closed hollow substantially symmetrical airfoil and wherein each such aerodynamic trip comprises an outwardly bent ridge extending along the length of the airfoil parallel to the leading edge.

18. A louver assembly as recited in claim 15 wherein the thickest part of the airfoil blade has a thickness about ½ of the length of the chord of the airfoil.

19. A louver assembly comprising:

a frame;

a plurality of elongated airfoil shaped blades mounted in the frame, each blade having a leading edge and a trailing edge, the space between adjacent blades having a converging portion downstream from the leading edge of the blades to the thickest part of the blades and a gradually diverging portion downstream from the thickest part of the blades; and aerodynamic trip means on each outside surface of each such blade, extending along the length of the blade in the converging portion of the space between adjacent blades, for inducing turbulence in the boundary layer of air flowing past each such surface of such airfoil shaped blade and lowering total drag through the louver assembly relative to total drag in absence of such aerodynamic trip means.

20. A louver assembly as recited in claim 19 wherein the means for inducting turbulence comprises a raised ridge extending above the surface of the airfoil parallel to the leading edge at a location aft of the leading edge about 1/5 of the length of the chord of the airfoil.

21. A louver assembly as recited in claim 19 wherein the thickest part of the airfoil blade has a thickness about ¼ of the length of the chord of the airfoil and wherein the spacing between the centers of adjacent blades is about the same as the length of the chord of the airfoil.

22. A louver assembly as recited in claim 19 wherein the means for inducing turbulence includes a trough recessed below at least one airfoil surface of such a blade and extending along the length of the blade spaced apart from the leading edge.

23. A louver assembly comprising:

a frame;

a plurality of louver blades mounted in the frame, each blade being fabricated of a single piece of uniform thickness sheet metal in the general shape of a closed hollow airfoil; and a sheet metal web having its edges frictionally secured between opposite inside surfaces of each of the airfoil blades with the width of the web normal to the plane of the airfoil chord to resist buckling of the blade.

24. An assembly as recited in claim 23 wherein each sheet metal web is in the general shape of a periodic wave, the crests of the wave being alternately on opposite sides of a plane normal to the plane of airfoil chord and extending along the length of the blade through the thickest part of the blade.

25. A louver assembly as recited in claim 24 wherein the shape of the periodic wave is a trapezoidal wave having parallel sides adjacent the crests of the wave in the general shape of zig-zagging corrugations.

26. A louver assembly as recited in claim 23 wherein the web has a width slightly greater than the distance between inside surfaces of the airfoil in the absence of the web for tight frictional engagement between the edges of the web and the inside surfaces of the airfoil.

27. A louver assembly as recited in claim 23 wherein the web has a sufficient extent between the leading edge and the trailing edge of the blade to prevent the web from falling over within the blade.

28. A louver assembly comprising:

a frame;

a plurality of elongated louver blades mounted in the frame, each blade fabricated in the general shape of a closed hollow airfoil; and a corrugated sheet metal web extending between opposite inside surfaces of the blade, the corrugations progressing along the length of the blade and with at least a portion of the opposite edges of the sheet metal engaging opposite surfaces of the inside of the blade, the width of the web extending normal to the plane of the airfoil chord for resisting buckling of the blade.

29. A louver assembly as recited in claim 28 wherein the corrugations are in a plurality of groups and consecutive groups are alternately on opposite sides of a plane normal to the plane of the airfoil chord and extending along the length of the blade through the thickest part of the blade.

30. A louver assembly as recited in claim 29 wherein alternate groups of corrugations are sufficiently far from said plane normal to the plane of the airfoil chord to prevent the web from falling over within the blade.

31. A louver assembly as recited in claim 28 wherein each blade is fabricated of a single piece of uniform thickness sheet metal in the general shape of a closed hollow airfoil and the sheet metal web has a thickness substantially less than the thickness of the sheet metal forming the blade.

32. A louver assembly as recited in claim 28 wherein the width of the web is slightly greater than an inside dimension of the blade in the absence of the web for frictional engagement with opposite inside surfaces of the blade.

33. A louver assembly as recited in claim 32 wherein the corrugations have a sufficient extent between the leading and trailing edges of the blade to prevent the web from falling over within the blade.

34. An adjustable louver assembly comprising:

a rectangular frame;

a plurality of elongated, substantially symmetrical airfoil shaped blades mounted in the frame for pivoting between open and closed positions, each blade being fabricated of a single piece of uniform thickness sheet metal in the general shape of a closed hollow airfoil; and means within each of the hollow blades for resisting buckling of the blade in a direction transverse to the plane of the airfoil chord, such means comprising a ribbon of sheet metal extending generally along the length of the blade and having its width normal to the plane of the airfoil chord, at least a portion of the edges of the ribbon being in frictional engagement with opposite inside surfaces of the blade.

35. An adjustable louver assembly as recited in claim 34 wherein the sheet metal ribbon includes corrugations progressing along the length of the blade and normal to the airfoil chord.

36. An adjustable louver assembly as recited in claim 35 wherein the corrugations are in a plurality of groups with adjacent groups of corrugations being on alternate sides of a plane normal to the airfoil chord and extending along the length of the blade through the thickest part of the blade.

37. An adjustable louver assembly as recited in claim 36 wherein the edges of at least the crests of such corrugations are in frictional engagement with inside surfaces of the blade, and wherein an intermediate portion of the ribbon between groups of corrugations extending across said plane through the thickest part of the blade is out of frictional engagement with the inside surfaces of the blade.

38. An adjustable louver assembly as recited in claim 34 wherein the sheet metal ribbon is in the general shape of a periodic wave having parallel side portions progressing along the length of the blade, alternate ones of said side portions being on opposite sides of a plane normal to the plane of the airfoil chord and through the thickest part of the blade.

39. An adjustable louver assembly as recited in claim 38 wherein the parallel side portions are in the general shape of zig-zagging corrugations.

40. A rain resistant louver assembly comprising:

a rectangular frame;

a plurality of parallel, horizontally extending hollow louver blades mounted in the frame;

permeable means extending along the length of each blade for admitting water from the outside of the blade to the hollow inside of the blade; and means at an end of each blade for gravitationally discharging water from the inside of each blade.

41. A louver assembly as recited in claim 40 wherein the permeable means extends along the blade adjacent the upstream edge of the blade.

42. A louver assembly as recited in claim 40 wherein the permeable means extends along the blade adjacent the downstream edge of the blade.

43. A louver assembly as recited in claim 42 wherein permeable means also extend along the blade adjacent the upstream edge of the blade.

44. A rain resistant louver assembly comprising:

a rectangular frame;

a plurality of parallel, horizontally extending hollow louver blades mounted in the frame, each of the louver blades having a leading edge and a trailing edge;

permeable means extending along the length of each blade on an upper surface of the blade near the trailing edge for admitting water from the outside of the blade to the hollow inside of the blade; and opening means at an end of each blade for discharging water from the inside of the blade to a side of the frame.

45. A louver assembly as recited in claim 44 wherein the permeable means comprises a row of holes extending through the surface of the blade near the trailing edge, such holes being arranged to intercept water flowing along the upper surface of the blade towards the trailing edge.

46. A louver assembly as recited in claim 44 wherein the permeable means comprises a row of chevron shaped slits through the surface of the blade, each of the chevron shaped slits having a tip pointed towards one end of the blade.

47. A louver assembly as recited in claim 46 wherein each of the chevron shaped slits is sufficiently closely nested with an adjacent chevron that the tip of one chevron shaped slit extends across a line between the wings of the adjacent chevron shaped slit.

48. A louver assembly as recited in claim 46 wherein the tab of metal adjacent each chevron shaped slit is bent inwardly from the outside surface of the blade to point into the inside of the blade.

49. A louver assembly as recited in claim 44 wherein the permeable means comprises a trough in the surface of the blade extending along the length of the blade and spaced apart from the trailing edge, and a plurality of holes between the inside and outside of the blade along the bottom of the trough.

50. A louver assembly as recited in claim 49 wherein each of the holes comprises a slit in the surface of the blade and a tab defined by the slit bent inwardly into the inside of the blade.

51. A louver assembly as recited in claim 44 wherein the permeable means comprises a plurality of holes in the surface of the blade, each of such holes being defined by a slit through the surface of the blade and a tab of metal defined by the slit bent inwardly into the inside of the blade.

52. A louver assembly as recited in claim 44 wherein the frame includes an open channel extending vertically along the side of the frame adjacent the opening means at the end of such blades and facing towards such opening means for conducting water downwardly along the frame.

53. A louver assembly as recited in claim 52 further comprising a second open side channel downstream from the first mentioned side channel and facing towards the upstream face of the frame, and a smoothly curving surface upstream of the second side channel for conveying water into the second side channel.

54. A louver assembly as recited in claim 53 wherein the second side channel further comprises a hook-like lip extending into the channel and spaced apart from the downstream portion of the channel to give the second side channel a generally G-shaped horizontal cross section.

55. A louver assembly as recited in claim 52 wherein the frame further comprises:

a wall trap gutter extending horizontally along the top of the frame to conduct water flowing down the outside of a frame supporting wall laterally away from the louver blades.

56. A louver assembly as recited in claim 55 further comprising a smoothly curved portion between such a frame supporting wall and the wall trap gutter so that water flowing down such supporting wall follows the curved portion into the wall trap gutter.

57. A louver assembly as recited in claim 55 wherein the frame further comprises a drip lip extending horizontally below the wall trap gutter, said drip lip having a sharp lower edge so that water dripping from the sharp edge is not blown through the louver assembly.

58. A rain resistant louver assembly comprising:

a generally vertical rectangular frame;

a plurality of parallel, horizontally extending hollow louver blades mounted in the frame, each of the louver blades having a leading edge and a trailing edge;

permeable means extending along the length of each blade on a surface of the blade near the leading edge for admitting water from the outside of the blade to the hollow inside of the blade; and opening means at an end of each blade for discharging water from the inside of the blade to a vertically extending side of the frame.

59. A louver assembly as recited in claim 58 wherein the permeable means comprises a row of holes extending through the surface of the blade near the leading edge.

60. A louver assembly as recited in claim 58 wherein the permeable means comprises a row of chevron shaped slits through the surface of the blade, each of the chevron shaped slits having a tip pointed towards one end of the blade.

61. A louver assembly as recited in claim 60 wherein each of the chevron shaped slits is sufficiently closely nested with an adjacent chevron that the tip of one chevron shaped slit extends across a line between the wings of the adjacent chevron shaped slit.

62. A louver assembly as recited in claim 60 wherein the tab of metal adjacent each chevron shaped slit is bent inwardly from the outside surface of the blade to point into the inside of the blade.

63. A louver assembly as recited in claim 58 wherein the permeable means comprises a trough in the surface of the blade extending along the length of the blade, and a plurality of holes between the inside and outside of the blade along the bottom of the trough.

64. A louver assembly as recited in claim 63 wherein each of the holes comprises a slit in the surface of the blade and a tab defined by the slit bent inwardly into the inside of the blade.

65. A louver assembly as recited in claim 58 wherein the permeable means comprises a plurality of holes in the surface of the blade, each of such holes being defined by a slit through the surface of the blade and a tab of metal defined by the slit bent inwardly into the inside of the blade.

66. A louver assembly as recited in claim 58 wherein the frame includes an open side channel extending vertically along the side of the frame adjacent the opening means at the end of such blades and facing towards such opening means for conducting water downwardly along the frame.

67. A louver assembly as recited in claim 66 further comprising a second open side channel downstream from the first mentioned side channel and facing towards the upstream face of the frame, and a smoothly curving surface upstream of the second side channel for conveying water into the second side channel.

68. A louver assembly as recited in claim 66 wherein the side channel further comprises a lip extending outwardly relative to the frame and spaced apart from the rear portion of the channel to give the side channel a generally G-shaped horizontal cross section.

69. A louver assembly as recited in claim 66 wherein the frame further comprises:

a wall trap gutter extending horizontally along the top of the frame to conduct water flowing down the outside of a frame supporting wall laterally away from the louver blades.

70. A louver assembly as recited in claim 69 further comprising a smoothly curved portion between such a frame supporting wall and the wall trap gutter so that water flowing down such supporting wall follows the curved portion into the wall trap gutter.

71. A louver assembly as recited in claim 69 wherein the frame further comprises a drip lip extending horizontally below the wall trap gutter, said drip lip having a sharp lower edge so that water dripping from the sharp edge is not blown through the louver assembly.

72. A rain resistant louver assembly comprising:

a rectangular frame;

a plurality of parallel, horizontally extending hollow louver blades mounted in the frame;

a trough in an upper surface of each of the blades extending along the length of such a blade for receiving rain water; and a plurality of holes between the inside and outside of the blades along the bottom of the trough for admitting rain water from the outside of the blades to the inside of the blades.

73. A louver assembly as recited in claim 72 wherein each of the holes comprising a slit in the surface of the blade and a tab defined by the slit bent inwardly into the inside of the blade.

74. A louver assembly as recited in claim 72 wherein each blade includes opening means at an end of the blade for discharging water from the inside of the blade, and the frame includes an open side channel extending vertically along the side of the frame adjacent the opening means at the end of such blades and facing towards such opening means for conducting water downwardly along the frame.

75. A louver assembly as recited in claim 74 further comprising a second open side channel downstream from the first mentioned side channel and facing towards the upstream face of the frame, and a smoothly curving surface upstream of the second side channel for conveying water into the second side channel.

76. A louver assembly as recited in claim 75 wherein the second side channel further comprises a hook-like lip extending into the channel and spaced apart from the downstream portion of the channel to give the second side channel a generally G-shaped horizontal cross section.

77. A rain resistant louver assembly comprising:

a rectangular frame;

a plurality of hollow louver blades mounted in the frame;

a trough in a surface of each of the blades extending along the length of such a blade; and a plurality of holes between the inside and outside of the blades along the bottom of the trough, wherein each of the holes comprises a chevron shaped slit having a tip pointed towards one end of the blade.

78. A louver assembly as recited in claim 77 wherein the tab of metal adjacent each chevron shaped slit is bent inwardly from the outside surface of the blade to point into the inside of the blade.

79. A louver assembly as recited in claims 77 or 78 wherein each chevron shaped slit is sufficiently closely nested with an adjacent chevron shaped slit so that the tip of one chevron shaped slit extends across a line between the wings of the adjacent chevron shaped slit.

80. A rain resistant louver assembly comprising:
a frame;
a plurality of hollow louver blades mounted in the frame, and
a row of chevron shaped slits through the surface of each blade, the row extending along the length of the blade, each of the chevron shaped slits having a tip pointed towards one end of the blade for admitting water from the outside of the blade to the hollow inside of the blade.

81. A louver assembly as recited in claim 80 wherein each chevron shaped slit is sufficiently closely nested with an adjacent chevron shaped slit that the tip of one chevron shaped slit extends across a line between the wings of the adjacent chevron shaped slit.

82. A louver assembly as recited in claim 80 wherein the generally triangular tab of material adjacent each chevron shaped slit is bent inwardly from the outside surface of the blade to point into the inside of the blade.

83. A louver assembly as recited in claim 82 wherein the chevron shaped slits are in a trough in the surface of the blade recessed below the surface of the blade.

84. A louver assembly as recited in claim 82 wherein each blade includes opening means at an end of the blade for discharging water from the inside of the blade, and the frame includes an open side channel extending vertically along the side of the frame adjacent the opening means at the end of such blades and facing towards such opening means for conducting water downwardly along the frame.

85. A louver assembly as recited in claim 84 further comprising a second open side channel downstream from the first mentioned side channel and facing towards the upstream face of the frame, and a smoothly curving surface upstream of the second side channel for conveying water into the second side channel.

86. A louver assembly as recited in claim 84 wherein the second side channel further comprises a hook-like lip extending into the channel and spaced apart from the downstream portion of the channel to give the second side channel a generally G-shaped horizontal cross section.

87. A louver assembly as recited in claim 84 wherein the frame further comprises:
a wall trap gutter extending horizontally along the top of the frame to conduct water flowing down the outside of a frame supporting wall laterally away from the opening of the louver frame.

88. A louver assembly as recited in claim 87 further comprising a smoothly curved portion between such a frame supporting wall and the wall trap gutter so that water flowing down such supporting wall follows the curved portion into the wall trap gutter.

89. A louver assembly as recited in claim 87 wherein the frame further comprises a drip lip extending horizontally below the wall trap gutter, said drip lip having a sharp lower edge so that water dripping from the sharp edge is not blown through the louver assembly.

90. A rain resistant louver assembly comprising:
a frame;
a plurality of hollow louver blades mounted in the frame; and
a row of chevron shaped slits through the surface of each blade leaving a generally triangular tab of material adjacent each chevron shaped slit, the tab of material being bent inwardly from the outside surface of the blade to point into the inside of the blade, the row extending along the length of the blade.

91. A louver assembly as recited in claim 90 wherein the row of slits extends along the length of the blade adjacent the trailing edge of the blade.

92. A louver assembly as recited in claim 90 wherein the row of slits extends along the length of the blade adjacent the leading edge of the blade.

93. A louver assembly as recited in claim 90 wherein the chevron shaped slits are in a trough in the surface of the blade recessed below the surface of the blade.

94. A rain resistant louver assembly comprising:
a frame;
a plurality of parallel, horizontally extending hollow louver blades mounted in the frame;
a first row of holes through the upper surface of each blade in a row extending along the lengh of the blade near the leading edge of the blade for admitting water from the outside of the blade to the inside of the blade;
a second row of holes through the upper surface of each blade in a row extending along the length of the blade near the trailing edge of the blade for admitting water from the outside of the blade to the inside of the blade; and
means at an end of each blade for discharging water from the hollow inside of the blade.

95. A rain resistant louver assembly comprising:
a frame;
a plurality of hollow louver blades mounted in the frame;
a first row of holes extending along the length of each blade near the leading edge of the blade for admitting water from the outside of the blade to the inside of the blade;
a second row of holes extending along the length of each blade near the trailing edge of the blade for admitting water from the outside of the blade to the inside of the blade wherein each row of holes comprises a row of chevron shaped slits through the surface of the blade, each of the chevron shaped slits having a tip pointed towards one end of the blade; and
means at an end of each blade for discharging water from the hollow inside of the blade.

96. A louver assembly as recited in claim 95 wherein each of the chevron shaped slits is sufficiently closely nested with an adjacent chevron shaped slit that the tip of one chevron shaped slit extends across a line between the wings of the adjacent chevron shaped slit.

97. A louver assembly as recited in claim 95 wherein the generally triangular tab of material adjacent each chevron shaped slit is bent inwardly from the outside surface of the blade to point into the inside of the blade.

98. A louver assembly as recited in claim 94 further comprising:
a first trough recessed below the surface of the blade extending along the length of the blade near the leading edge and wherein the row of holes near the leading edge of the blade is along the bottom of the first trough; and
a second trough recessed below the surface of the blade extending along the length of the blade near the trailing edge and wherein the row of holes near the trailing edge of the blade is along the bottom of the second trough.

99. A louver assembly as recited in claim 94 wherein each of the holes comprises a slit in the surface of the blade and a tab defined by the slit bent inwardly into the inside of the blade.

100. A louver assembly as recited in claim 94 wherein each blade includes a web extending between inside surfaces of the blade at a location between the first and second rows of holes for inhibiting air flow through the blade.

101. A louver assembly as recited in claim 94 wherein each blade includes opening means at an end of the blade for discharging water from the inside of the blade, and the frame includes an open side channel extending vertically along the side of the frame adjacent the opening means at the end of such blades and facing towards such opening means for conducting water downwardly along the frame.

102. A louver assembly as recited in claim 101 further comprising a second open side channel downstream from the first mentioned side channel and facing towards the upstream face of the frame, and a smoothly curving surface upstream of the second side channel for conveying water into the second side channel.

103. A louver assembly as recited in claim 101 wherein the second side channel further comprises a hook-like lip extending into the channel and spaced apart from the downstream portion of the channel to give the second side channel a generally G-shaped horizontal cross section.

104. A louver assembly as recited in claim 101 wherein the frame further comprises:

a wall trap gutter extending horizontally along the top of the frame to conduct water flowing down the outside of a frame supporting wall laterally away from the louver blades.

105. A louver assembly as recited in claim 104 further comprising a smoothly curved portion between such a frame supporting wall and the wall trap gutter so that water flowing down such supporting wall follows the curved portion into the wall trap gutter.

106. A louver assembly as recited in claim 104 wherein the frame further comprises a drip lip extending horizontally below the wall trap gutter, said drip lip having a sharp lower edge so that water dripping from the sharp edge is not blown through the louver assembly.

107. An adjustable louver assembly comprising:

a frame;

a plurality of louver blades mounted in the frame, each blade having a leading edge and a trailing edge defining a chord line therebetween; and a pivot bearing at each end of such a louver blade for connecting such blade to the frame for pivoting the blades between an open position and a closed position about 90° from the open position, the axis of the pivot bearings intersecting a line passing approximately through the center of the chord line at an angle of approximately 45° with the chord line, wherein the angle is measured from the chord line in the angular direction in which the chord line rotates when moving the blade from the open position towards the closed position, whereby the center of the chord line is substantially the same distance from an edge of the frame when the blades are in the open position and when the blades are in the closed position.

108. An adjustable louver assembly as recited in claim 107 wherein the axis of the pivot bearings is between the center of the chord line and the leading edge and is sufficiently far from the center of the chord line to be outside the surface of the blade.

109. An adjustable louver assembly as recited in claim 107 further comprising a control rod; and control bearing means connecting each such blade with the control rod, wherein the axis of the control rod bearing is on the opposite side of the blade from the pivot bearing axis, and intersects a line extending through the pivot bearing axis at an approximately 45° angle with the chord line.

110. A louver blade comprising:

a blade skin surrounding a hollow interior of the blade;

a row of holes through the skin of the blade, the row extending along the length of the blade near an edge thereof, such holes being arranged to intercept liquid flowing along the surface of the blades towards such edge for admitting liquid from the outside of the blade to the hollow interior thereof, wherein each of the holes comprises a slit in the surface of the blade and a tab defined by the slit bent inwardly into the inside of the blade a sufficient distance for developing a sufficient gravitational head to cause water to drip off the tabs into the blade; and means for discharging liquid from the hollow interior of the blade at at least one end thereof.

111. A louver blade comprising:

a blade skin surrounding a hollow interior of the blade;

a row of holes through the skin of the blade, the row extending along the length of the blade near an edge thereof, such holes being arranged to intercept liquid flowing along the surface of the blades towards such edge for admitting liquid from the outside of the blade to the hollow interior thereof, wherein the row of holes comprises a row of chevron shaped slits through the surface of the blade, each of the chevron shaped slits having a tip pointed towards one end of the blade; and means for discharging liquid from the hollow interior of the blade at at least one end thereof.

112. A louver assembly as recited in claim 111 wherein each of the chevron shaped slits is sufficiently closely nested with an adjacent chevron shaped slit that the tip of one chevron shaped slit extends across a line between the wings of the adjacent chevron shaped slit.

113. A louver blade as recited in claim 111 wherein the generally triangular tab adjacent each chevron shaped slit is bent inwardly from the outside surface of the blade to point into the hollow interior of the blade.

114. A louver blade comprising:

a blade skin surrounding a hollow interior of the blade;

a trough in the surface of the blade extending generally along the length of the blade adjacent an edge of the blade for intercepting liquid flowing along the surface of the blades towards such edge;

a plurality of holes through the skin of the blade in the trough for admitting liquid from the outside of the blade to the hollow interior thereof; and means for discharging liquid from the hollow interior of the blade; and wherein each of the holes comprises a chevron shaped slit having a tip pointing towards one end of the blade.

115. A louver blade as recited in claim 114 wherein each chevron shaped slit is sufficiently closely nested with an adjacent chevron shaped slit that the tip of one chevron shaped slit extends across a line between the wings of the adjacent chevron shaped slit.

116. A louver blade as recited in claim 115 wherein the generally triangular tab adjacent each chevron shaped slit is bent inwardly from the outside surface of the blade to point into the hollow interior of the blade.

117. A louver blade comprising:

a sheet metal skin formed in an airfoil shape surrounding a hollow interior of the blade, the airfoil having a leading edge and a trailing edge;

a first permeable region extending along the length of the blade near the trailing edge arranged for intercepting water flowing along the surface of the blade towards the trailing edge;

a second permeable region extending along the length of the blade near the leading edge for admitting water from the exterior of the blade to the interior of the blade; and means at at least one end of the blade for discharging water from the hollow interior of the blade.

118. A louver blade as recited in claim 117 wherein the permeable region includes at least a portion extending into the hollow interior of the blade further than the thickness of the sheet metal skin.

119. A louver blade as recited in claim 117 further comprising means between the first and second permeable regions for inhibiting air flow through the hollow interior of the blade between the first permeable region and the second permeable region.

120. A louver blade comprising:

a sheet metal skin formed in an airfoil shape surrounding a hollow interior of the blade, the airfoil having a leading edge and a trailing edge;

a permeable region extending along the length of the blade near such an edge arranged for intercepting water flowing along the surface of the blade towards such edge, wherein the permeable region comprises a row of chevron shaped slits through the sheet metal skin of the blade, each of the chevron shaped slits having a tip pointed towards one end of the blade; and means at at least one end of the blade for discharging water from the hollow interior of the blade.

121. A louver blade as recited in claim 128 wherein each of the chevron shaped slits is sufficiently closely nested with an adjacent chevron shaped slit that the tip of one chevron shaped slit extends across a line between the wings of the adjacent chevron shaped slit.

122. A louver blade as recited in claim 121 wherein the generally triangular tab adjacent each chevron shaped slit is bent inwardly from the outside surface of the blade to point into the hollow interior of the blade.

123. A louver blade comprising:

a sheet metal skin forming in an airfoil shape surrounding a hollow interior of the blade, the airfoil having a leading edge and a trailing edge;

a permeable region extending along the length of the blade near such an edge arranged for intercepting water flowing along the surface of the blade towards such edge, wherein the permeable region comprises a row of slits in the sheet metal skin of the blade and a tab defined by each slit bent inwardly into the hollow interior of the blade a sufficient distance for developing a sufficient gravitational head to cause water to drip off the tabs into the blade; and means at at least one end of the blade for discharging water from the hollow interior of the blade.

124. An elongated louver blade comprising:

a blade skin formed into an airfoil shaped transverse cross section of the blade defining a leading edge of the blade, a trailing edge of the blade, and a geometric chord between the leading edge and the trailing edge;

a sufficient surface ridge on each outside surface of the blade extending along the length of the blade parallel to the leading edge at a location approximately 1/5 of the chord length downstream from the leading edge of the blade for inducing mixing of the boundary layer fluid with higher energy fluid in a fluid stream for delaying separation of fluid flow from the blade.

125. An elongated louver blade comprising:

a blade skin formed into an airfoil shaped transverse cross section defining a leading edge of the blade, a trailing edge of the blade, and a geometric chord between the leading edge and the trailing edge;

a raised ridge formed in the skin of the blade on each outside surface of the blade extending parallel to the length of the blade at a location approximately 1/5 of the chord length downstream from the leading edge of the blade for inducing mixing of the boundary layer fluid with higher energy fluid in a fluid stream for delaying separation of fluid flow from the blade.

126. A louver blade as recited in claim 125 wherein the louver blade is hollow and is formed from a single piece of substantially uniform thickness sheet metal and wherein the surface irregularity is embossed into the sheet metal.

127. A louver blade comprising:

a blade skin formed into a substantially symmetrical airfoil having a leading edge, a trailing edge, and a hollow interior; and a sufficient surface irregularity on each side of the blade extending along the length of the blade on the outside surface of the blade between the leading edge and the thickest portion of the blade for inducing mixing of boundary layer air with higher energy air in an air stream for delaying separation of air flow from the blade.

128. A louver blade as recited in claim 127 wherein the maximum thickness of the blade is about ½ of the chord length of the blade and the surface irregularity extends along the length of the blade at a location approximately 1/5 of the chord length downstream from the leading edge.

129. A louver blade as recited in claim 128 wherein each surface irregularity comprises a raised ridge in the outside surface of the blade extending along the length of the blade.

130. A louver blade comprising:

a blade skin formed into an elongated airfoil shape having a hollow interior; and a ribbon-like web in the hollow interior of the blade extending lengthwise along the blade approximately along the plane of greatest thickness of the blade, the width of the web being greater than the distance between inside surfaces of the blade if the web were not present for holding the two opposite sides of the blade apart and holding the web in place by spring forces exerted by the sides of the blade on the edges of the web, wherein the web comprises a plurality of corrugations progressing along the blade, the web standing on edge within the blade with the width of the web extending normal to the plane of the airfoil chord for resisting buckling of the blade.

131. A louver blade as recited in claim 130 wherein the corrugations are in a plurality of groups and consecutive groups are alternately on opposite sides of a plane normal to the plane of the airfoil chord and extending along the length of the blade through the thickest part of the blade.

132. A louver blade as recited in claim 131 wherein the alternate groups of corrugations are sufficiently far from said plane normal to the plane of the airfoil chord to prevent the web from falling over within the blade.

133. A louver blade as recited in claim 130 wherein the blade skin is fabricated of a single piece of uniform thickness sheet metal in the general shape of a closed hollow airfoil, and the web comprises sheet metal that has a thickness substantially less than the thickness of the sheet metal forming the blade.

134. An adjustable louver assembly comprising:

a frame;

a plurality of elongated louver blades;

a blade pivot bearing having its axis parallel to the length of the blade at each end of each blade for pivotally mounting such a blade in the frame;

a control rod bearing connected to each blade; and a control rod connected to the control rod bearings for controlling the attitude of the blades between an open position and a closed position wherein the relative spacings between the control bearings along the length of the control rod are progressively varied along the length of the control rod to compenate for longitudinal strain of the control rod for closing the blades symmetrically and with substantially equal force exerted on each blade.

135. A louver assembly having an air intake face and an air exhaust face comprising:

a rectangular frame having a top, a bottom and parallel slides;

a plurality of louver blades mounted in the frame;

an open side channel extending vertically along each side of the frame for conducting water downwardly along the frame; and a hollow rectangular discharge conduit interconnecting a side of the frame and the bottom of the frame at each lower corner of the frame, each such discharge conduit having an open end at one face of the assembly and a water inlet aperture between the side channel and the interior of the conduit for receiving water from the side channel and discharging water at said face of the assembly.

136. A louver assembly as recited in claim 135 further comprising a discharge conduit interconnecting a side of the frame and the top of the frame at each upper corner of the frame, each such discharge conduit having an open end at one face of the assembly for discharging water;

gutter means extending along the top of the frame for receiving water flowing into the gutter means; and means for discharging water from the gutter means into such a discharge conduit.

137. A louver assembly having an air intake face and an air exhaust face comprising:

a rectangular frame having a top, a bottom, and parallel sides;

a plurality of louver blades mounted in the frame;

a gutter extending long the top of the frame recessed behind one face of the frame;

means for guiding water into the gutter;

a hollow corner discharge conduit interconnecting the top and each side of the frame; and means for discharging water from the gutter into the discharge conduit.

138. A louver assembly as recited in claim 137 wherein each corner discharge conduit comprises a hollow rectangular tube welded to a side of the frame and to the top of the frame for holding the side and top together.

139. A louver assembly as recited in claim 137 further comprising:

a channel in the top of the frame extending along the length of the top and having a larger transverse cross section than the gutter;

a plurality of openings between the gutter and the channel for conveying water from the gutter into the channel; and means for discharging water from the channel into the hollow corner discharge conduit.

140. A louver assembly as recited in claim 137 wherein the means for guiding water into the gutter comprises a smoothly curving surface above the gutter extending from one face of the louver assembly into the gutter.

141. A louver assembly having an air intake face and an air exhaust face comprising:

a rectangular frame having a top, a bottom, and parallel sides;

a plurality of louver blades mounted in the frame;

a gutter extending along the top of the frame from one side of the frame to the other side of the frame, the edge of the gutter being flush with one face of the frame; and a smoothly curving transition region above the gutter for leading liquid streaming downwardly into the gutter.

142. A louver assembly as recited in claim 140 further comprising:

a channel extending along the top of the frame from one side of the frame to the other side of the frame, the channel having a larger transverse cross section than the gutter; and a plurality of openings between the gutter and the channel for discharging water from the gutter into the channel.

143. A louver assembly having an air intake face and an air exhaust face comprising:

a rectangular frame having a top, a bottom, and parallel sides;

a plurality of hollow louver blades mounted in the frame;

means for introducing water into the hollow blades along the length of the blades;

means for discharging water from at least one end of the blades;

an open side channel extending vertically along at least one side of the frame adjacent the means for discharging water for conducting water downwardly along the frame.

144. A louver assembly as recited in claim 143 further comprising a second side channel extending vertically along each side of the frame near the air exhaust face of the frame; and a smoothly curving surface between the second side channel and the air intake face of the louver assembly for conveying water into the side channel.

145. A louver assembly as recited in claim 143 wherein the second side channel further comprises a hook-like lip extending into the channel and spaced apart from the air exhaust face of the frame to give the side channel a generally G-shaped horizontal cross section.

146. A louver assembly as recited in claim 143 further comprising a discharge conduit at each lower corner of the frame, each such discharge conduit having an open end at the air intake face of the assembly and an inlet aperture between such a side channel and the interior of the conduit.

147. A louver assembly as recited in claim 146 wherein the discharge conduits each comprise a hollow rectangular corner piece providing an interconnection between the bottom and a side of the frame.

148. A louver assembly as recited in claim 143 wherein the frame further comprises:

a wall trap gutter extending horizontally along the top of the frame to conduct water flowing down the outside of a frame supporting wall laterally away from the louver blades.

149. A louver assembly as recited in claim 148 further comprising a smoothly curved transition portion between such a frame supporting wall and the wall trap gutter so that water flowing down such supporting water follows the curved portion into the wall trap gutter.

150. An adjustable louver assembly comprising:

a rectangular frame having parallel side members, at least one of the side members including a control rod receiving channel extending along its length;

a plurality of hollow elongated airfoil shaped blades having a blade end piece welded into each end, each of the blade end pieces including an integral pivot arm extending outside of the airfoil surface of the blade on one side of the chord of the airfoil;

pivot bearing means connecting each blade end piece pivot arm to a side member of the frame for pivoting such a blade between an open position and a closed position;

a control arm integral with at least one blade end piece at an end of each blade extending outside the airfoil surface of the blade and coplanar with the respective pivot arm, such a control arm being on the opposite side of the chord of the airfoil from such pivot arm;

a control rod in the control rod receiving channel of such a frame side member; and control rod bearing means connecting the control arm on each of the blades to the control rod for control of the attitude of the blades, the face of the control rod adjacent the blade end piece being spaced substantially the same distance from the control arm as the face of the frame side member adjacent the blade end piece is spaced from the pivot arm.

151. An adjustable louver assembly comprising:

a rectangular frame having a frame edge member;

a plurality of elongated blades pivotally mounted in the frame for pivoting between an open position and a closed position;

a seal between such a frame edge member and an edge of such a blade in the closed position comprising:

a first recess extending along the frame edge member and opening towards one face of the frame;

a second recess extending along the frame edge member and opening towards the other face of the frame; and a thin seal strip extending along the frame edge member, the seal strip having a first inwardly folded edge loosely fitted in the first recess, a second inwardly folded edge loosely fitted in the second recess and a curved portion between the folds extending into the arc traversed by the blade edge as the blade pivots between the open and closed positions for elastically sealing against the blade edge.

152. An adjustable louver assembly according to claim 10 wherein the tips of the tabs of metal adjacent the slits extend into the hollow blade to guide liquid on the surface of the blade down the chevron-shaped slits and into the hollow blade.

* * * * *

UNITED STATES PATENT AND TRADEMARK OFFICE

CERTIFICATE OF CORRECTION

PATENT NO. : 4,263,842

DATED : April 28, 1981

INVENTOR(S) : R. David Moore

It is certified that error appears in the above—identified patent and that said Letters Patent is hereby corrected as shown below:

Column 5, line 2, "liner" should be -- linear --.
Column 15, line 39, "such" should be -- much --.
Column 21, line 24, "1/2" should be -- 1/4 --;
Column 21, line 45, "inducting" should be -- inducing --.
Column 24, line 38, --side-- should be inserted after "open" and before "channel".
Column 26, line 27, "comprisin-" should be -- comprises --.
Column 31, line 44, "128" should be -- 120 --;
Column 31, line 54, "forming" should be -- formed --.
Column 32, line 45, "1/2" should be -- 1/4 --.
Column 33, line 32, "compenate" should be -- compensate --;
Column 33, line 66, "long" should be -- along --.
Column 34, line 37, "140" should be -- 141 --.

Signed and Sealed this

*Twenty-ninth* Day of *September 1981*

[SEAL]

*Attest:*

*Attesting Officer*

GERALD J. MOSSINGHOFF

*Commissioner of Patents and Trademarks*